US010643816B1

(12) United States Patent
Choi et al.

(10) Patent No.: US 10,643,816 B1
(45) Date of Patent: May 5, 2020

(54) X-RAY EMITTING DEVICE COMPRISING A FOCUSING ELECTRODE COMPOSED OF A CERAMIC-BASED MATERIAL

(71) Applicant: aweXomeRay Co., Ltd., Seoul (KR)

(72) Inventors: Hong Soo Choi, Seoul (KR); Se Hoon Gihm, Seongnami-Si (KR); Keun Soo Jeong, Seoul (KR)

(73) Assignee: aweXomeRay Co., Ltd., Seoul (KR)

( * ) Notice: Subject to any disclaimer, the term of this patent is extended or adjusted under 35 U.S.C. 154(b) by 0 days.

(21) Appl. No.: 16/666,852

(22) Filed: Oct. 29, 2019

(30) Foreign Application Priority Data

Apr. 4, 2019 (KR) ..... 10-2019-0039773

(51) Int. Cl.
*H01J 35/14* (2006.01)
*H01J 35/06* (2006.01)

(52) U.S. Cl.
CPC ..... *H01J 35/14* (2013.01); *H01J 35/064* (2019.05); *H01J 35/066* (2019.05); *H01J 2201/30469* (2013.01)

(58) Field of Classification Search
CPC ..... H01J 3/14; H01J 3/02; H01J 3/04; H01J 29/488; H01J 29/80; H01J 29/701; H01J 29/46; H01J 29/84; H01J 2229/481; H01J 2229/4817; H01J 35/14; H01J 35/064; H01J 35/066; H01J 2201/30469
See application file for complete search history.

(56) References Cited

U.S. PATENT DOCUMENTS

| | | | | |
|---|---|---|---|---|
| 7,550,907 | B2 | 6/2009 | Jiang et al. | |
| 2003/0002627 | A1 | 1/2003 | Espinosa et al. | |
| 2007/0003472 | A1 | 1/2007 | Tolt | |
| 2009/0208742 | A1 | 8/2009 | Zhu et al. | |
| 2010/0260931 | A1 | 10/2010 | Malecki et al. | |
| 2011/0116603 | A1* | 5/2011 | Kim | H01J 35/065 378/119 |
| 2017/0292208 | A1 | 10/2017 | Yoon et al. | |

FOREIGN PATENT DOCUMENTS

| | | | |
|---|---|---|---|
| EP | 3315644 | A1 | 5/2018 |
| JP | H05347142 | A | 12/1993 |
| JP | 2002293629 | A | 10/2002 |
| JP | 2007128892 | A | 5/2007 |
| JP | 2011148689 | A | 8/2011 |
| JP | 2012010583 | A | 1/2012 |
| JP | 2016046145 | A | 4/2016 |
| KR | 20070041024 | A | 4/2007 |
| KR | 20120090383 | | 10/2010 |
| KR | 101284226 | B1 | 7/2013 |

(Continued)

OTHER PUBLICATIONS

Office Action for KR1020190039773 dated Jul. 1, 2019.

(Continued)

*Primary Examiner* — Joseph L Williams
*Assistant Examiner* — Jose M Diaz
(74) *Attorney, Agent, or Firm* — Young Basile Hanlon & MacFarlane, P.C.

(57) ABSTRACT

The present invention provides an X-Ray emitting device that comprises a focusing electrode composed of a ceramic-based material, which can be manufactured by a simple process and is excellent in durability.

23 Claims, 16 Drawing Sheets

(56) References Cited

FOREIGN PATENT DOCUMENTS

| | | | |
|---|---|---|---|
| KR | 1020140147004 | | 12/2014 |
| KR | 20160102743 | A | 8/2016 |
| KR | 20160118637 | A | 10/2016 |
| KR | 101718784 | | 3/2017 |
| KR | 1020170041365 | | 4/2017 |
| KR | 20170121266 | | 11/2017 |
| KR | 1020180044114 | | 5/2018 |
| KR | 101876076 | B1 | 7/2018 |
| KR | 20180104642 | A | 9/2018 |
| KR | 101962215 | B1 | 3/2019 |
| KR | 101956153 | B1 | 6/2019 |

OTHER PUBLICATIONS

Office Action for KR1020190039773 dated Oct. 17, 2019.
Office Action for KR10-2018-0152222 dated Mar. 10, 2019.
Office Action for KR 1020190009430 dated Apr. 25, 2019.
Potentially related U.S. Appl. No. 16/666,834, filed Oct. 29, 2019.
Potentially related U.S. Appl. No. 16/666,844, filed Oct. 29, 2019.
Potentially related U.S. Appl. No. 16/572,902, filed Sep. 17, 2019.
International Search Report received for PCT Patent Application No. PCT/KR2019/014070 dated Jan. 30, 2020, 3 pages.

* cited by examiner

[Fig. 1]
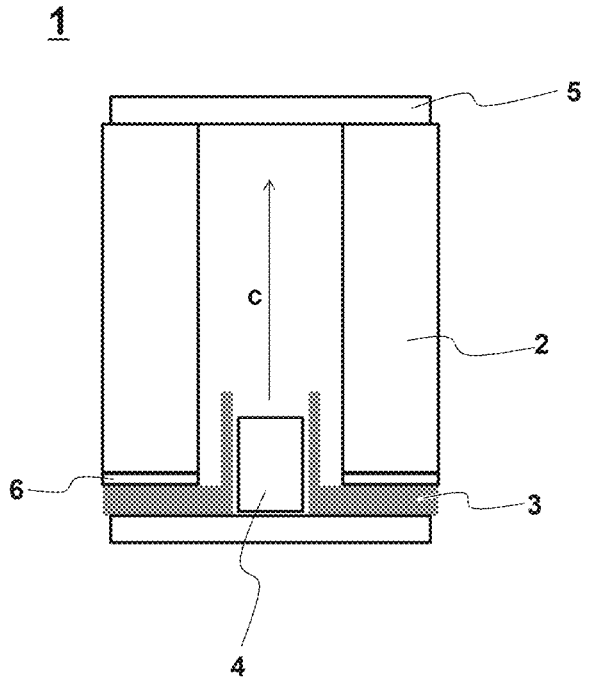

[Fig. 2]
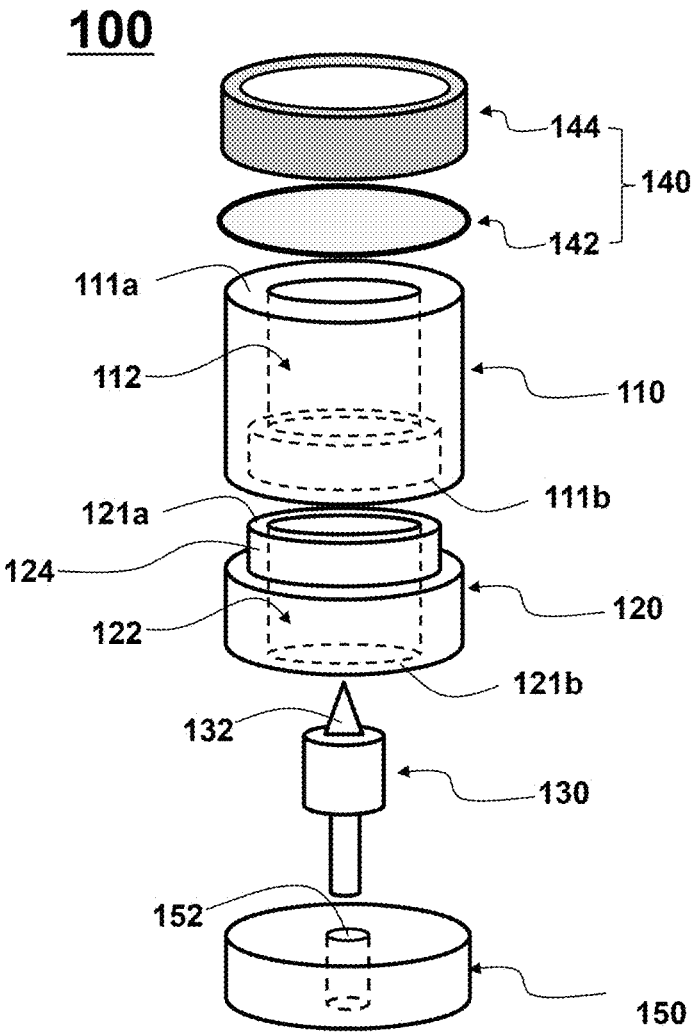

[Fig. 3]
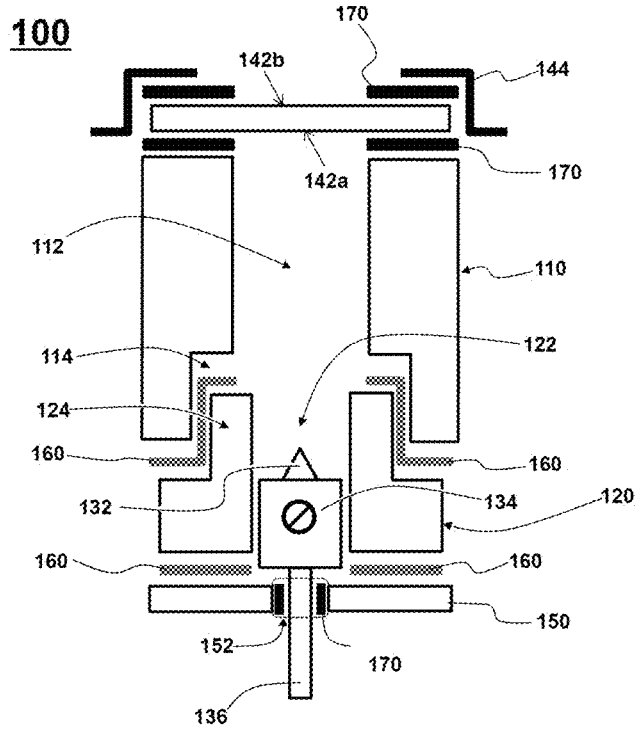
[Fig. 4]
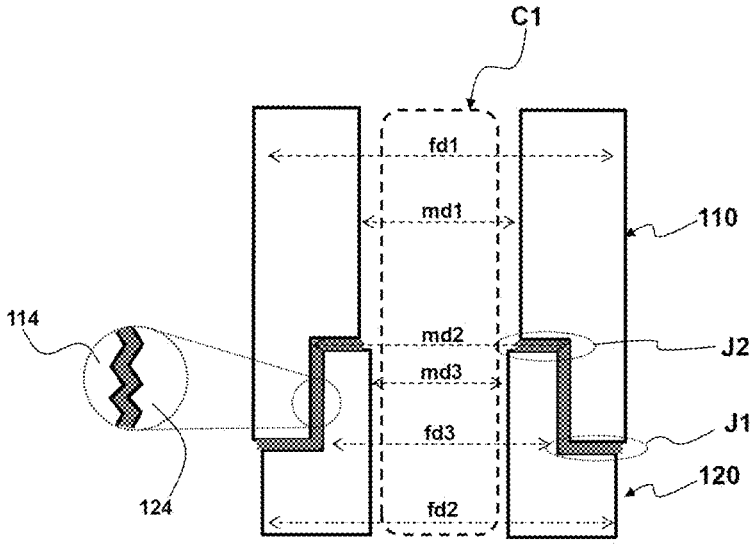

[Fig. 5]
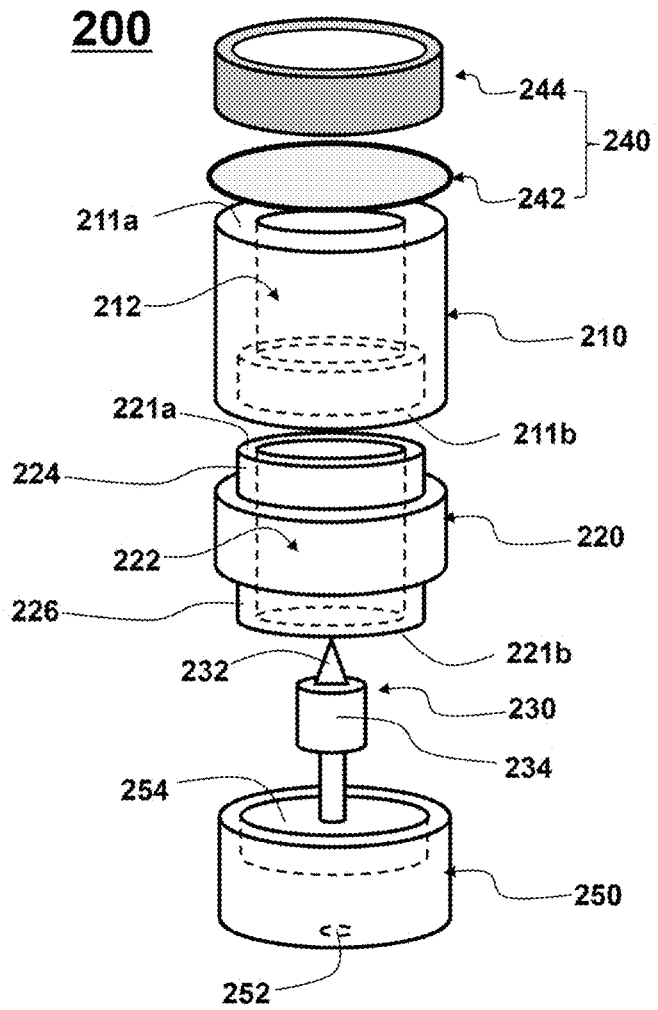

[Fig. 6]
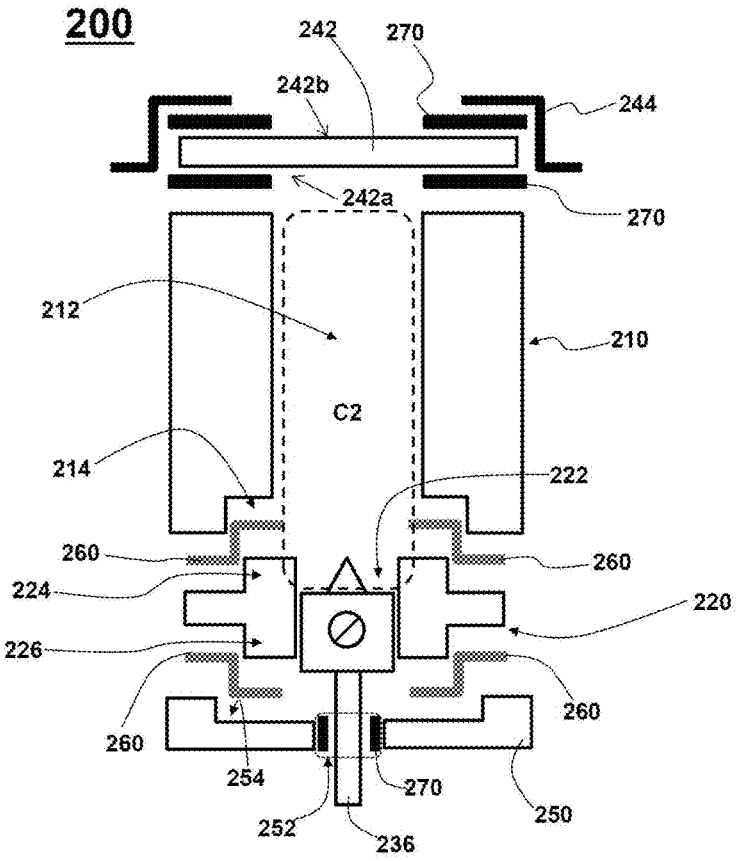

[Fig. 7]
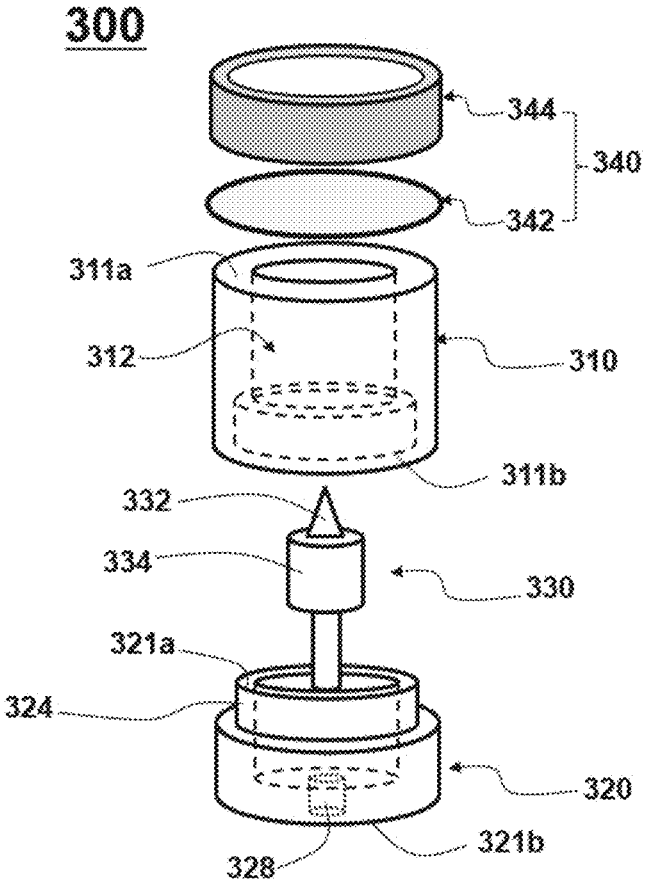

[Fig. 8]
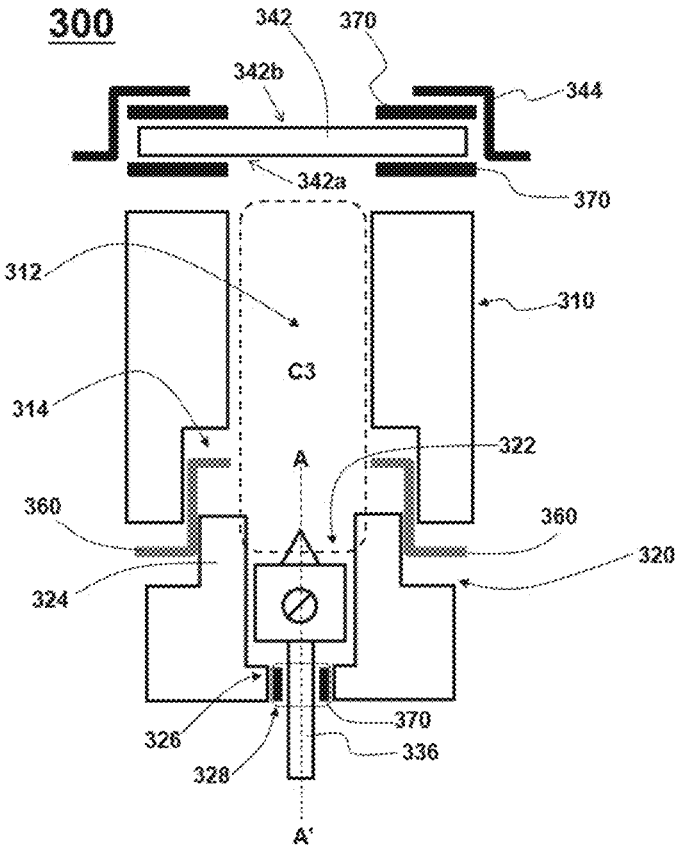

[Fig. 9]
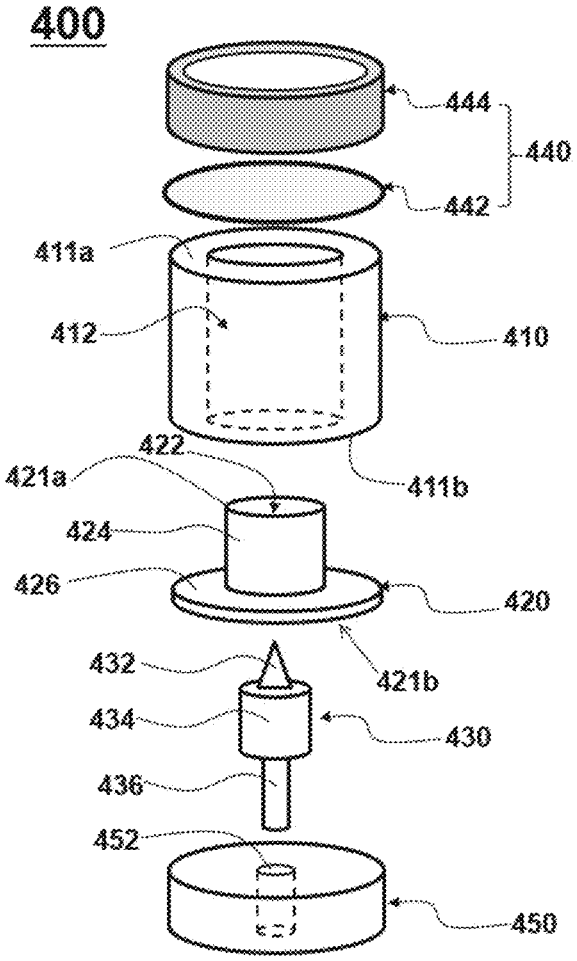

[Fig. 10]
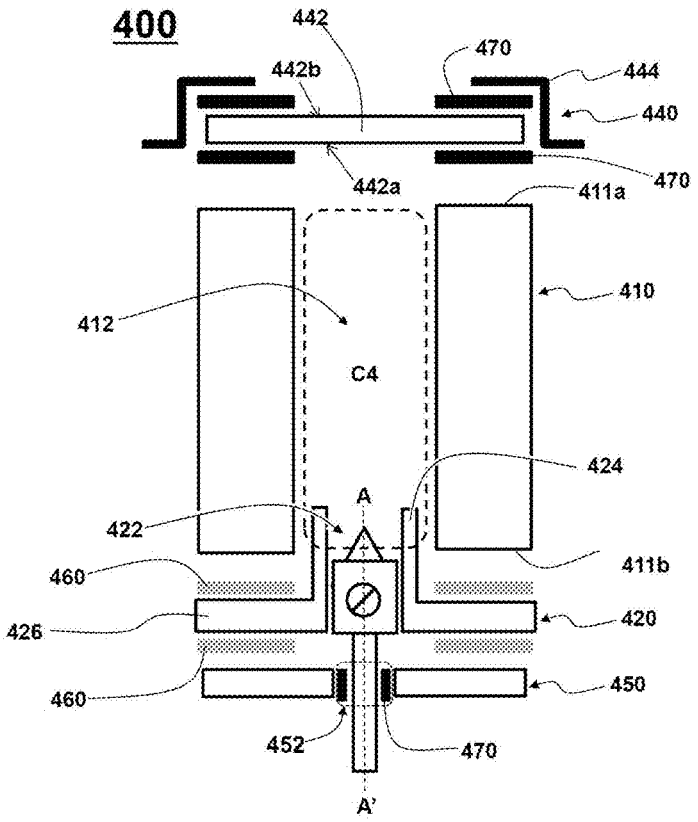

[Fig. 11]
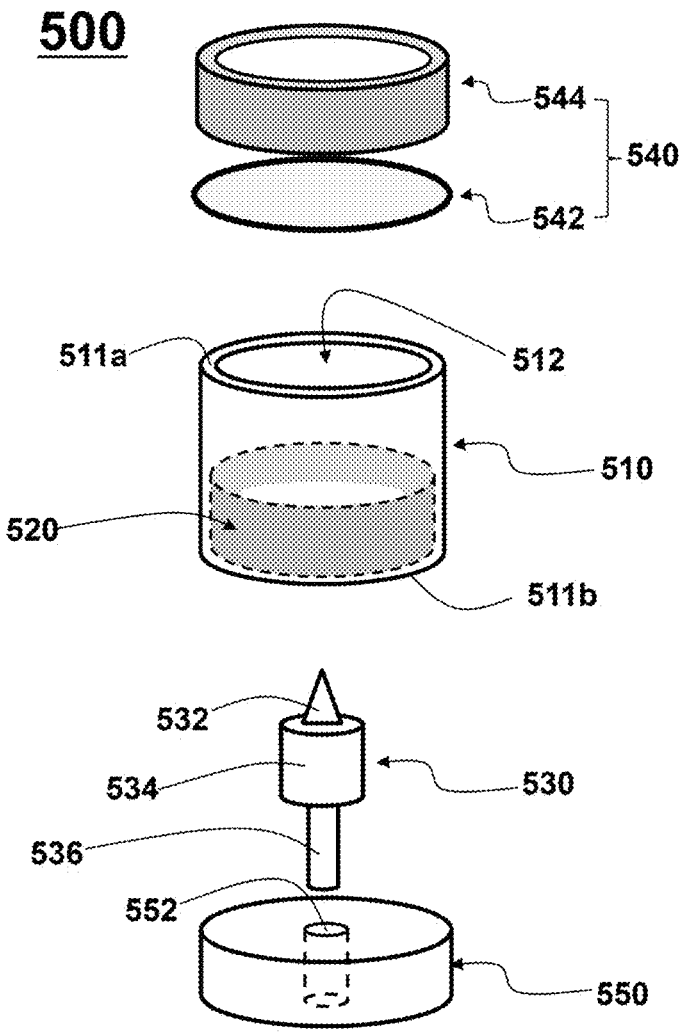

[Fig. 12]
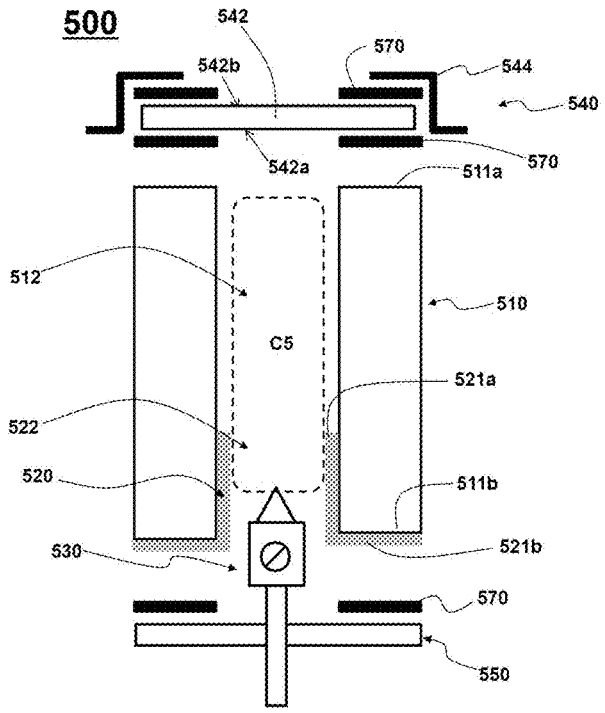
[Fig. 13]
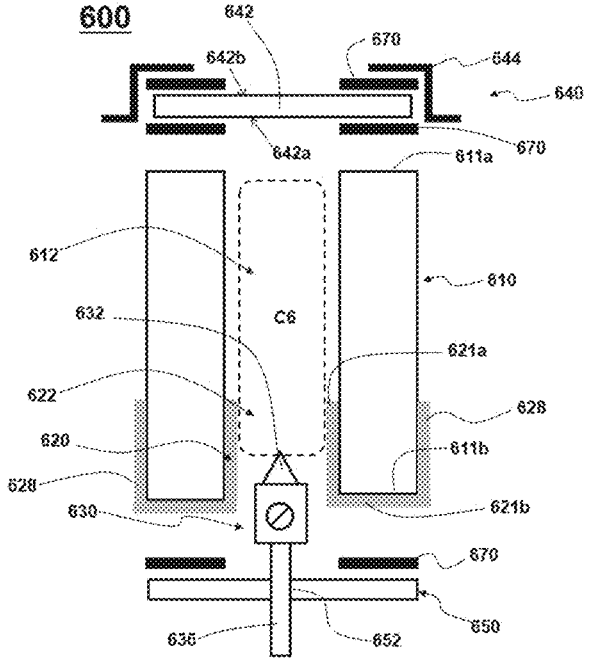

[Fig. 14]
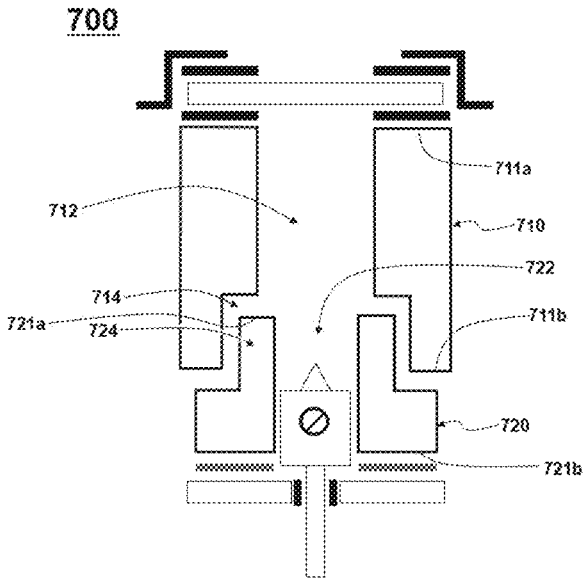
[Fig. 15]
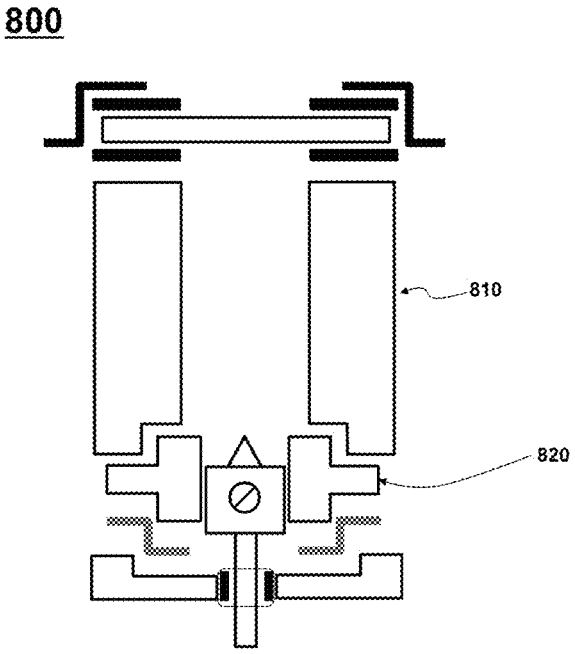

[Fig. 16]
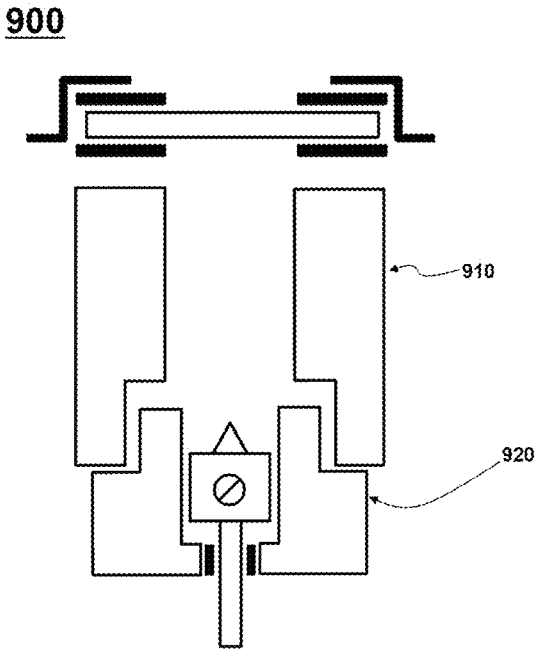
[Fig. 17]
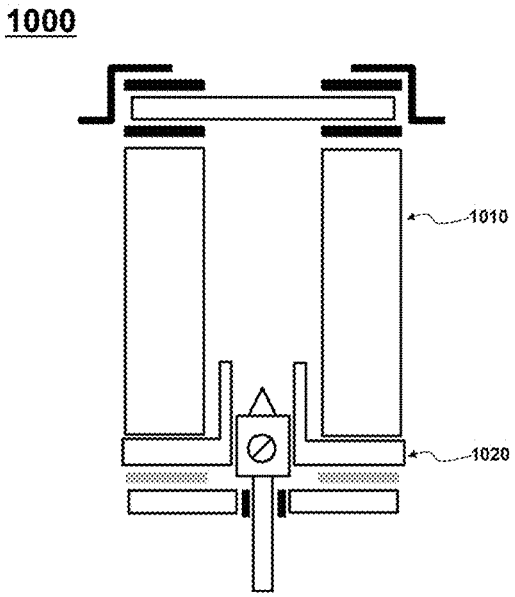

[Fig. 18]
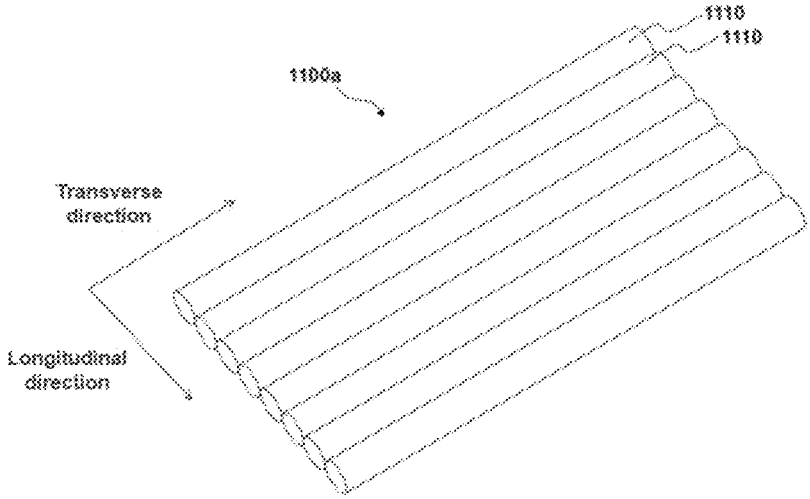
[Fig. 19]
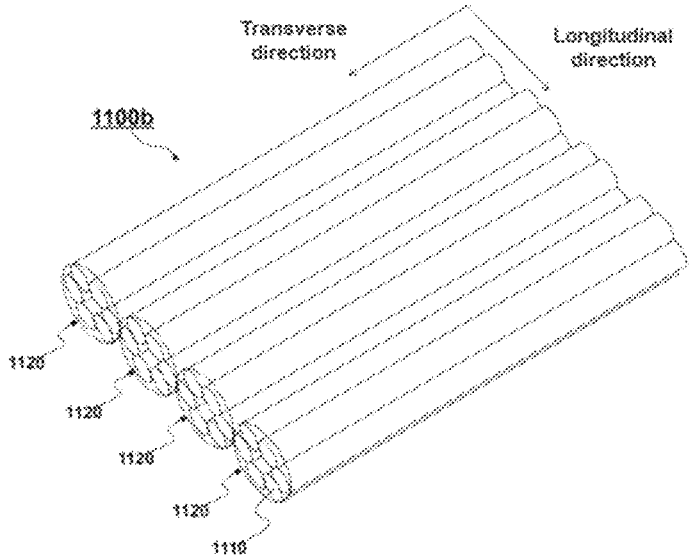

[Fig. 20]
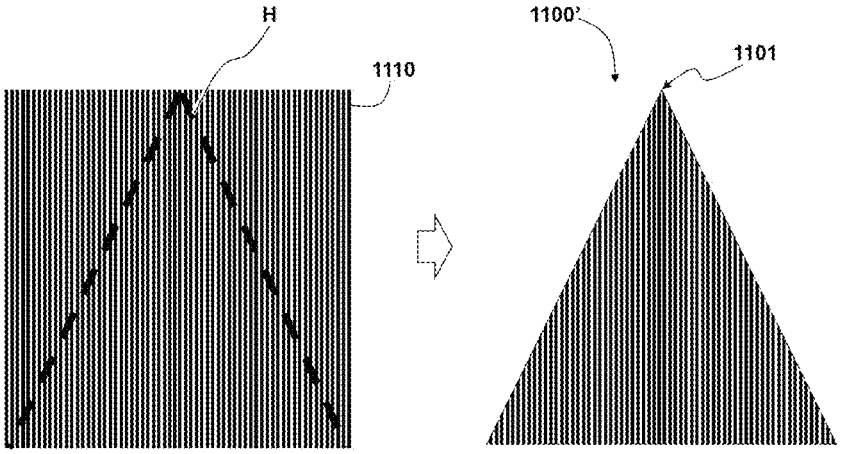
[Fig. 21]
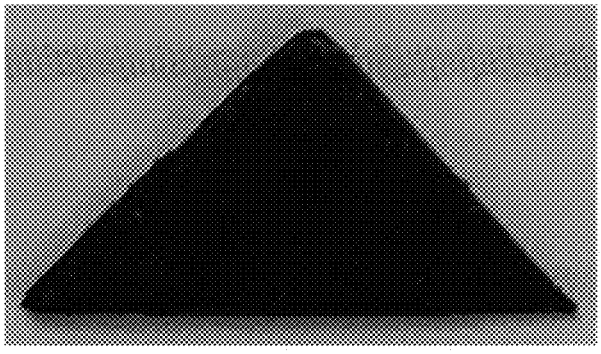

[Fig. 22]
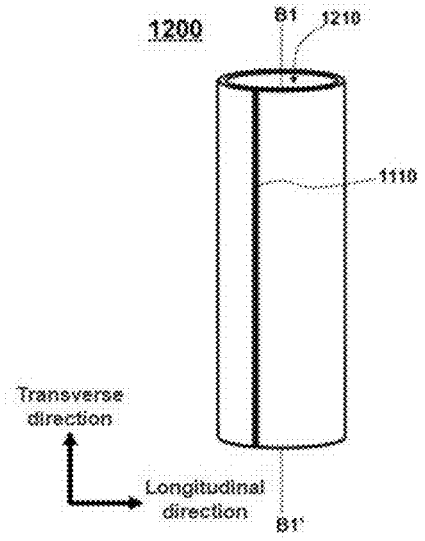
[Fig. 23]
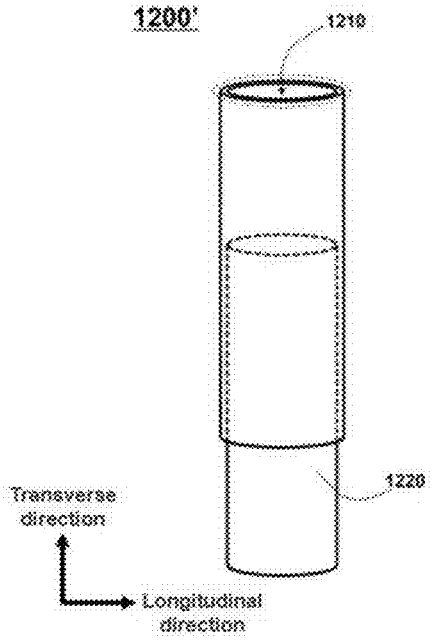

X-RAY EMITTING DEVICE COMPRISING A FOCUSING ELECTRODE COMPOSED OF A CERAMIC-BASED MATERIAL

CROSS-REFERENCE TO RELATED APPLICATION

This application is based on and claims priority under 35 U.S.C. § 119(a) to Korean Patent Application No. 10-2019-0039773, which was filed on Apr. 4, 2019, in the Korean Intellectual Property Office, the disclosure of which is incorporated herein in its entirety by reference.

TECHNICAL FIELD

The present invention relates to an X-ray emitting device that comprises a focusing electrode composed of a ceramic-based material.

BACKGROUND ART OF THE INVENTION

X-rays widely used for medical, industrial, and research purposes can be generated, for example, when high-energy electrons collide with a metal target. The electron source used to generate X-rays includes a thermionic source that induces electron emission by heating a metallic material and a field emission electron source that uses a nanomaterial.

The thermionic source has such disadvantages as a relatively short life span and difficulties in miniaturization, controlling the intensity of X-rays, and integration of a device.

On the other hand, the field emission electron source that uses a nanomaterial has such advantages that it is possible to have various electrical and physical forms and to generate X-rays at a higher power than those of a thermionic source, and it is easy to control the intensity of X-rays and to achieve integration and miniaturization of a device.

One example of such a field emission electron source is an X-ray emitting device in the form of a tube, which can be easily miniaturized. X-ray emitting devices are widely used in the fields of industrial systems for inspecting defects and quality, medical brachytherapy, 3D digital diagnostic imaging systems, and the like.

Meanwhile, a schematic structure on a vertical cross-section of a typical X-ray emitting device in a tube form is shown in FIG. 1. Referring to FIG. 1, the schematic structure and operation principle of an X-ray emitting device will be described.

The X-ray emitting device (1) may comprise an emitter (4) for emitting electrons when a voltage is applied, an anode (5) for emitting X-rays when the electrons emitted from the emitter (4) collide therewith, a tube (2) for providing an electron transfer path between the emitter (4) and the anode (5) and ensuring electrical insulation, and a focusing electrode (3) for focusing the electrons emitted from the emitter (4).

In the conventional X-ray emitting device (1), the tube (2) is made of glass, which is easy to process and hardly absorbs X-rays, and a ferronickel alloy is typically used for the focusing electrode (3).

As described above, in the conventional X-ray emitting device (1), the tube (2) and the focusing electrode (3) are made of different materials. Thus, in order to join them, a complicated process has been typically carried out in which the surfaces of the tube (2) and the focusing electrode (3) to be joined are subjected to metalizing treatment, followed by brazing (6) treatment.

The tube (2) and the focusing electrode (3) thus joined together form the body of the X-ray emitting device (1), and the inside thereof forms a communicating hollow, which serves as a closed electron transfer channel (c) in which electrons can move from the emitter (4) to the anode (5). The electron transfer channel (c) can be maintained in a vacuum.

However, the conventional X-ray emitting device (1) described above has a technical problem in terms of structural stability and difficulties in the manufacturing process.

Specifically, the tube (2) made of glass has low mechanical strength and may thus be easily broken. In addition, it is difficult, despite the metalizing and brazing (6) treatment, that glass and metal, which are different materials from each other, can be joined in such a desirable bonding state as not to be damaged by an external force and without deformation by the heat generated in the X-ray emitting device (1).

Further, due to the difference in thermal expansion coefficients between glass and metal, which are different materials from each other, relatively strong stress may be applied to the joining interface by the thermal shrinkage of the tube (2) and the focusing electrode (3). This may cause a problem that the joining state of the tube (2) and the focusing electrode (3) may be damaged or deformed when the X-ray emitting device (1) is used repeatedly or for a long period of time.

For this reason, the conventional X-ray emitting device (1) is not excellent in durability. In particular, the sealing state of the electron transfer channel (c) may be impaired by the damage or deformation of the bonding state, which may lead to a problem that the degree of vacuum is deteriorated.

In terms of the difficulties of the manufacturing process, the metalizing and brazing (6) treatment is a process with a significantly high degree of difficulty and precision. Thus, it is difficult to manufacture the conventional X-ray emitting device. In particular, when it is miniaturized, the defect rate is high. In another aspect, the metalizing and brazing (6) treatment requires skilled manpower and the cost is high as well, which may raise the price of the X-ray emitting device (1).

Accordingly, there is a demand for a novel X-ray emitting device, which addresses the technical problems described above.

DISCLOSURE OF THE INVENTION

Technical Problem to be Solved

An object of the present invention is to provide an X-ray emitting device having a novel structure, which entirely solves the problems of the conventional technologies described above.

In an aspect of the present invention, the X-ray emitting device comprises an electron transfer part and an electron focusing part, each of which is composed of a ceramic-based material.

In such event, the electron focusing part may be a focusing electrode, and the electron transfer part may be in the form of a tube having a hollow. The electron transfer part and the electron focusing part may be coupled to each other to form an electron transfer channel.

The electron transfer part and the electron focusing part composed of a ceramic-based material are excellent in strength as compared with glass. It is possible to substantially solve the structural problem such as the instability of the joining state caused by different thermal expansion coefficients between the different materials in the conventional devices that adopt a glass tube and a metallic focusing electrode.

In addition, the electron transfer part and the electron focusing part composed of a ceramic-based material do not necessarily require a process with a high degree of difficulty and a high cost such as metallization and brazing.

In an example, since both the electron transfer part and the electron focusing part are composed of a ceramic-based material, they can be easily joined by a ceramic-based adhesive. In another example, a paste-type electron focusing part may be hardened to be joined to the electron transfer part.

In accordance with this aspect, the present invention provides a novel X-ray emitting device, which can address the structural instability of the conventional X-ray emitting devices, that is, breakage due to low strength and damage to the joining state caused by the difference in thermal expansion coefficients, and can be conveniently manufactured while minimizing such a process with a high degree of difficulty as metallization and brazing.

Solution to the Problem

Before the present invention is specifically described, the terms and words used in the present specification and claims should not be construed as limited to ordinary or dictionary terms. They must be construed in accordance with the technical idea of the present invention based on the principle that an inventor is allowed to appropriately define the concept of terms in order to explain its own invention in the best way.

Accordingly, it is to be understood that the constitution of the embodiments described in the present specification is merely the most preferred embodiment of the present invention and does not represent all the technical ideas of the present invention; thus, various equivalents and changes for substituting them at the time of filing the present application can be made.

As used herein, a singular expression covers a plural expression unless the context clearly dictates otherwise. In this specification, it is to be understood that the terms "comprise," "provide," "have," and the like indicate the presence of features, numbers, steps, elements, or combinations thereof performed; and that they do not exclude the presence of the possibilities of addition of one or more of other features, numbers, steps, elements, or combinations thereof.

As used herein, the term "introduction" may be described interchangeably with "feed" and "injection," and it may be understood to mean the input or addition of a liquid, a gas, heat, or the like.

As used herein, the term "aggregation" is used interchangeably with "gathering, collection, binding" and refers to a form in which a plurality of carbon nanotubes are attached to one another by the n-n interaction.

As used herein, the term "yarn" refers to any yarn formed by the growth of carbon nanotubes in a fiber form or by gathering, aggregation, and/or fusion of a plurality of carbon nanotubes in a fiber form.

As used herein, the term "base end" may refer to an end of an object or a target or a direction toward the end with respect to an arbitrary reference direction. The "front end" may refer to the other end or a direction toward the other end with respect to the arbitrary reference direction. Here, the base end may include an end, a proximal end, and/or a part that is very close to an end that constitutes an object or a target. The front end may include an end, a distal end, and/or a part that is very close to an end, which is opposite to the base end. These base end and front end may be recognized as a concept of a pair and may be distinguished from other ends, distal ends and/or parts that are very close to the ends.

In an embodiment, the present invention provides an X-ray emitting device, which comprises an electron transfer part in the form of a tube, which comprises a first base end, a first front end, and a first hollow part extending between the first base end and the first front end;

an electron focusing part in the form of a tube, which comprises a second base end, a second front end, and a second hollow part extending between the second base end and the second front end;

an electron transfer channel formed by the coupling of the electron transfer part and the electron focusing part in which the first hollow part and the second hollow part are communicated;

an emitter part comprising an emitter that emits electrons in the electron transfer channel; and an X-ray emitting part installed at the first front end, which emits an X-ray generated by collision with an electron that passes through the electron transfer channel outside the electron transfer channel, wherein the electron transfer part and the electron focusing part are each composed of an electrically conductive ceramic-based material.

In a specific example, the X-ray emitting device may further comprise a ceramic-based sealing material, which is applied between the adjacent sides of the electron transfer part and the electron focusing part to bond and seal the adjacent sides.

In a specific example, the electron transfer part may be composed of a ceramic-based material comprising O and further comprising at least one element selected from the group consisting of Al, Si, Cr, Mg, Y, and Zr.

In a specific example, the electron focusing part may be composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

The ceramic-based materials may have an electrical conductivity of at least $1 \cdot 10^2$ S/cm.

In a specific example, the electron focusing part is a focusing electrode, which focuses electrons emitted from the emitter part in random directions and reaching the electron focusing part to guide the electrons in the form of an electron beam directed in one direction to the electron transfer part.

The emitter of the emitter part may be located in the second hollow part.

In a specific example, the emitter part may further comprise an electrically conductive emitter holder to which the emitter is seated and secured and a vacuum tube connected to the emitter holder, wherein the emitter holder may be located in the second hollow part.

In a specific example, the X-ray emitting part may comprise a metal target plate and a top cap.

In a specific example, the metal target plate may comprise a first side and a second side opposite to the first side, wherein the central portion of the first side is exposed to the electron transfer channel, and the peripheral portion of the first side excluding the central portion of the first side may be joined to the end of the electron transfer part by brazing.

In a specific example, the top cap may comprise an opening to expose the central portion of the second side to the outside of the electron transfer channel and may be joined to the peripheral portion of the second side by brazing while it is in contact with the peripheral portion of the second side, excluding the central portion of the second side, and the lateral side of the metal target plate to surround them.

In a specific example, the metal target plate of the X-ray emitting part is joined to the first front end by brazing to seal the first front end, and the second hollow part may be in a sealed structure while the emitter and the emitter holder of the emitter part are located in the second hollow part.

In a specific example, a first tube groove having a structure recessed in the direction of the outer peripheral side of the electron transfer part may be formed along the inner peripheral side of the electron transfer part on at least a part of the inner peripheral side of the electron transfer part adjacent to the first base end.

In a specific example, a first tube arm having a structure recessed in the direction of the inner peripheral side of the electron focusing part may be formed along the outer peripheral side of the electron focusing part on at least a part of the outer peripheral side of the electron focusing part adjacent to the second front end.

In a specific example, the first tube groove and the first tube arm may be complementarily engaged.

In an aspect of the above, a ceramic-based sealing material is applied between the complementarily engaged sides of the first tube groove and the first tube arm to bond and seal the complementarily engaged sides.

In another aspect, the complementarily engaged sides of the first tube groove and the first tube arm may be in a mutually bonded state.

For example, while the electron transfer part and the electron focusing part are coupled by the complementary engagement of the first tube groove and the first tube arm, they are calcined so that the complementarily engaged sides are fused to be joined to each other. In such event, the calcination temperature may be at least 500° C., specifically at least 700° C., more specifically 700° C. to 2,000° C. In a specific example, the electron focusing part may further comprise an annular flange protruding outward in the radial direction of the tube from the outer peripheral side of the second base end, wherein at least a part of the electron focusing part excluding the second base end and the flange is located in the first hollow part, and a ceramic-based sealing material is applied between the adjacent sides of the flange and the first base end to bond and seal the adjacent sides.

In a specific example, the X-ray emitting device may further comprise an end cap.

In a specific example, the end cap may comprise a penetrating hole through which the vacuum tube of the emitter part passes and the inner peripheral side of which is joined to the vacuum tube by brazing, and the end cap is coupled to the second base end to seal the second base end.

In a specific example, the end cap may be composed of a ceramic-based material, wherein a ceramic-based sealing material is applied between at least a part of the adjacent sides of the electron focusing part and the end cap to bond and seal the adjacent sides.

In a specific example, the end cap may be composed of a ceramic-based material or an electrically conductive metal, wherein at least a part of the adjacent sides of the electron focusing part and the end cap are joined to each other by brazing.

In a specific example, a second tube arm having a structure recessed in the direction of the inner peripheral side of the electron focusing part may be formed along the outer peripheral side of the electron focusing part on at least a part of the outer peripheral side of the electron focusing part adjacent to the second base end, a groove having a complementary shape to the second tube arm is formed at the central portion of the end cap, and a ceramic-based sealing material is applied between the complementarily engaged sides of the groove of the end cap and the second tube arm to bond and seal the complementarily engaged sides.

In a specific example, a third tube arm having a structure protruding inward in the radial direction of the tube may be formed along the inner peripheral side of the electron focusing part on the inner peripheral side of the electron focusing part adjacent to the second base end, and the inner peripheral side of the third tube arm and the vacuum tube may be coupled by brazing to seal the second base end.

In a specific example, the electron focusing part may be a tube block formed from a ceramic-based material in a mold having a predetermined shape.

In a specific example, the electron focusing part may be formed by the hardening of a ceramic paste comprising a ceramic-based material on a part of the inner peripheral side adjacent to the first base end and the first base end.

In a specific example, the electron focusing part may comprise a closing part formed by the hardening of a ceramic paste comprising a ceramic-based material on a part of the outer peripheral side adjacent to the first base end.

In a specific example, the ceramic-based sealing material may have an adhesive strength of 1 $N/mm^2$ to 50 $N/mm^2$ to the ceramic-based material.

In a specific example, the ceramic-based material may comprise O and further comprise at least one element selected from the group consisting of Al, Si, Cr, Mg, Y, and Zr.

In a specific example, the emitter may be a carbon nanotube sheet that comprises carbon nanotubes.

Advantageous Effects of the Invention

As describe above, the X-ray emitting device according to the present invention comprises an electron transfer part and an electron focusing part, each of which is composed of a ceramic-based material.

In the present invention, the electron focusing part is a focusing electrode, the electron transfer part is in the form of a tube having a hollow, and the electron transfer part and the electron focusing part are coupled to each other to form an electron transfer channel.

In this structure, the electron transfer part and the electron focusing part are composed of a ceramic-based material that is excellent in strength as compared with glass. Thus, the X-ray emitting device has an advantage that the durability is excellent even when it is used for a long period of time.

Particularly noteworthy is that the electron transfer part and the electron focusing part that constitute the electron transfer channel are composed of the same material, so that they hardly have a difference in the thermal expansion coefficient therebetween. Therefore, it is possible to substantially prevent the problem that the joining state between the materials having different thermal expansion coefficients is gradually damaged by the heat generated in the X-ray emitting device as in the conventional devices that adopt a glass tube and a metal focusing electrode.

In another aspect, the electron transfer part and the electron focusing part composed of a ceramic-based material do not necessarily require such a process with a high degree of difficulty and a high cost as metallization and brazing; therefore, the degree of difficulty in the manufacturing process of the X-ray emitting device can be improved.

For example, since both the electron transfer part and the electron focusing part are composed of a ceramic-based material in the present invention, they can be easily joined by a ceramic-based adhesive. In another example, a paste-type electron focusing part may be applied to the electron transfer part and hardened in place.

In sum, the present invention provides a novel X-ray emitting device, which can address the structural instability of the conventional X-ray emitting devices, that is, breakage due to low strength and damage to the joining state due to the difference in thermal expansion coefficients, and can be conveniently manufactured while minimizing a process with a high degree of difficulty such as metallization and brazing.

BRIEF DESCRIPTION OF THE DRAWINGS

FIG. 1 is a schematic diagram on a vertical cross-sectional of an X-ray emitting device according to the prior art.

FIG. 2 is a schematic exploded diagram of an X-ray emitting device according to an example of the present invention.

FIG. 3 is a schematic diagram on a vertical cross-sectional of the X-ray emitting device according to FIG. 2.

FIG. 4 is a schematic diagram on a vertical cross-sectional of the electron transfer channel of FIGS. 2 and 3.

FIG. 5 is a schematic exploded diagram of an X-ray emitting device according to another example of the present invention.

FIG. 6 is a schematic diagram on a vertical cross-sectional of the X-ray emitting device according to FIG. 5.

FIG. 7 is a schematic exploded diagram of an X-ray emitting device according to still another example of the present invention.

FIG. 8 is a schematic diagram on a vertical cross-sectional of the X-ray emitting device according to FIG. 7.

FIG. 9 is a schematic exploded diagram of an X-ray emitting device according to still another example of the present invention.

FIG. 10 is a schematic diagram on a vertical cross-sectional of the X-ray emitting device according to FIG. 9.

FIG. 11 is a schematic exploded diagram of an X-ray emitting device according to still another example of the present invention.

FIG. 12 is a schematic diagram on a vertical cross-sectional of the X-ray emitting device according to FIG. 11.

FIG. 13 is a schematic cross-sectional diagram of an X-ray emitting device according to still another example of the present invention.

FIG. 14 is a schematic diagram on a vertical cross-sectional of an X-ray emitting device according to still another example of the present invention.

FIG. 15 is a schematic diagram on a vertical cross-sectional of an X-ray emitting device according to still another example of the present invention.

FIG. 16 is a schematic diagram on a vertical cross-sectional of an X-ray emitting device according to still another example of the present invention.

FIG. 17 is a schematic diagram on a vertical cross-sectional of an X-ray emitting device according to still another example of the present invention.

FIG. 18 is a schematic diagram of a carbon nanotube sheet used as an emitter according to an example of the present invention.

FIG. 19 is a schematic diagram of a carbon nanotube sheet used as an emitter according to another example of the present invention.

FIG. 20 is a schematic diagram of a carbon nanotube sheet used as an emitter according to still another example of the present invention.

FIG. 21 is a photograph of the carbon nanotube of FIG. 20.

FIG. 22 is a schematic diagram of a carbon nanotube sheet used as an emitter according to still another example of the present invention.

FIG. 23 is a schematic diagram of a carbon nanotube sheet used as an emitter according to still another example of the present invention.

DETAILED DESCRIPTION FOR CARRYING OUT THE INVENTION

<X-Ray Emitting Device>

The X-ray emitting device according to the present invention comprises an electron transfer part in the form of a tube, which comprises a first base end, a first front end, and a first hollow part extending between the first base end and the first front end;

an electron focusing part in the form of a tube, which comprises a second base end, a second front end, and a second hollow part extending between the second base end and the second front end;

an electron transfer channel formed by the coupling of the electron transfer part and the electron focusing part in which the first hollow part and the second hollow part are communicated;

an emitter part comprising an emitter that emits electrons in the electron transfer channel; and an X-ray emitting part installed at the first front end, which emits an X-ray generated by collision with an electron that passes through the electron transfer channel outside the electron transfer channel, wherein the electron transfer part and the electron focusing part are each composed of an electrically conductive ceramic-based material.

Accordingly, the specific structure of the X-ray emitting part that can be practiced in the scope of the present invention will be described in detail with reference to the following non-limiting examples.

FIG. 2 shows an X-ray emitting device according to an example of the present invention, and FIG. 3 shows a vertical cross-sectional diagram thereof. In addition, FIG. 4 shows a schematic diagram of an electron transfer channel.

Referring to these drawings, the X-ray emitting device (100) comprises an electron transfer part (110), an electron focusing part (120), an emitter part (130) comprising an emitter (132) for emitting electrons when a voltage is applied, and an X-ray emitting part (140).

The X-ray emitting device (100) further comprises an electron transfer channel (C1) formed by the coupling of the electron transfer part (110) and the electron focusing part (120).

In addition, the X-ray emitting device (100) further comprises a ceramic-based sealing material (160), which couples the electron transfer part (110) and the electron focusing part (120) and seals the coupled part from the outside.

The ceramic-based sealing material (160) is applied between the adjacent sides of the electron transfer part (110)

and the electron focusing part (120) to bond and seal the adjacent sides. In the present invention, both the electron transfer part (110) and the electron focusing part (120) may be composed of a ceramic-based material. The ceramic-based sealing material (160) has an advantage that it may not only securely couple the electron transfer part (110) and the electron focusing part (120), which are composed of the same material, but also simplify the joining process.

The ceramic-based sealing material (160) may be a material having an adhesive strength of 1 $N/mm^2$ to 50 $N/mm^2$ to a ceramic-based material. Specifically, it may comprise a ceramic-based material that comprises O (oxygen) and further comprises at least one element selected from the group consisting of Al, Si, Cr, Mg, Y, and Zr.

The electron transfer part (110) is in the form of a tube and comprises a first base end (111*b*), a first front end (111*a*), and a first hollow part (112) extending between the first base end (111*b*) and the first front end (111*a*). In addition, the electron transfer part (110) may be composed of a ceramic-based material comprising O and further comprising at least one element selected from the group consisting of Al, Si, Cr, Mg, Y, and Zr.

The electron transfer part (110) is a tube block formed from the ceramic-based material in a mold having a predetermined shape.

The outer diameter (fd1) of the electron transfer part (110) may be determined in consideration of the size of the X-ray emitting device (100) to be implemented, but it is preferable that the size is appropriate to minimize the absorption of electrons or X-rays that pass through it and to minimize the deterioration of the mechanical strength. In this respect, the desirable outer diameter (fd1) of the electron transfer part (110) may be 2 mm to 20 cm.

A first tube groove (114) having a structure recessed in the direction of the outer peripheral side of the electron transfer part (110) may be formed along the inner peripheral side of the electron transfer part (110) on at least a part of the inner peripheral side of the electron transfer part adjacent (110) to the first base end (111*b*). Here, the inner peripheral side may correspond to the inner side defining the first hollow part (112), and the outer peripheral side may correspond to the outermost side of the electron transfer part (110) surrounding the first hollow part (112) with respect to the first hollow part.

The first hollow part (112) has a step in the region where the first tube groove (114) exists with reference to the vertical cross-section according to FIG. 3. The inner diameter of the first hollow part (112) excluding the step may be determined to a desired value in consideration of the size and the output of the X-ray emitting device (100) to be implemented. For example, it may have at least one inner diameter (md1, first inner diameter) selected from a range of 0.7 mm to 12 cm.

However, if the inner diameter (md2, second inner diameter) at the step is too small with respect to the first inner diameter (md1), the coupling force with the electron focusing part (120) to be described later may be deteriorated. This is because the area contactable with the electron focusing part (120) is reduced in the above case under the circumstance that the electron transfer part is coupled to the electron focusing part (120) while the first tube groove (114) is in contact with a part of the electron focusing part. In addition, if the second inner diameter (md2) is too large, the strength at the first base end (111*b*) of the electron transfer part (110) may be too low, which is also undesirable.

Thus, the present invention provides a preferred range of the second inner diameter (md2), which may be specifically 110% to 150%, more specifically 120% to 140%, of the first inner diameter (md1).

The electron focusing part (120) is a focusing electrode, which focuses electrons emitted from the emitter part (130) in random directions and reaching the electron focusing part to guide the electrons in the form of an electron beam directed in one direction to the electron transfer part (110).

The electron focusing part (120) is in the form of a tube and comprises a second base end (121*b*), a second front end (121*a*), and a second hollow part (122) extending between the second base end (121*b*) and the second front end (121*a*).

The electron focusing part (120) may be composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

The electron focusing part (120) is a tube block formed from the ceramic-based material in a mold having a predetermined shape.

A first tube arm (124) having a structure recessed in the direction of the inner peripheral side of the electron focusing part (120) is formed along the outer peripheral side of the electron focusing part (120) on at least a part of the outer peripheral side of the electron focusing part (120) adjacent to the second front end (121*a*). Here, the inner peripheral side may correspond to the inner side defining the second hollow part (122), and the outer peripheral side may correspond to the outermost side of the electron focusing part (120) surrounding the second hollow part (122) with respect to the second hollow part.

The outer side of the electron focusing part (120) adjacent to the second front end (121*a*) has a step in the region where the first tube arm (124) exists with reference to the vertical cross-section according to FIG. 3. In such event, the outer diameter of the electron focusing part (120) excluding the step may be determined to a desired value in consideration of the size and the output of the X-ray emitting device (100) to be implemented. For example, it may be the same as the outer diameter of the electron transfer part (110) or have at least one outer diameter (fd2, first outer diameter) selected from a range of 2 mm to 20 cm.

However, if the outer diameter (fd3, second outer diameter) at the step of the electron focusing part (120) is too small with respect to the first outer diameter (fd2), the strength of the second front end (121*a*), specifically the first tube arm (124), of the electron focusing part (120) may be excessively deteriorated, which is not desirable.

On the other hand, if the second outer diameter (fd3) is too large, the stability of the coupling between the electron focusing part (120) and the electron transfer part (110) may be deteriorated.

For example, a part (J1 in FIG. 4) of the electron focusing part (120) may be coupled with the base end (111*b*) of the electron transfer part (110) while they are in contact with each other. At the same time, a part (J2 in FIG. 4) of the first tube arm (124) may be coupled with the opposite first tube groove (114) while they are in contact with each other.

However, as the second outer diameter (fd3) is increased, the area of the part (J2) of the first tube arm (124) is relatively expanded, and the area of the part (J1) of the first tube arm (124) is relatively narrowed. Thus, the coupling force of each of these parts (J1, J2) to the electron transfer part (110) may greatly vary.

If the unbalance of the coupling force at the different parts is increased as described above, damage is likely to occur to the coupling at any of the parts having a rather weak coupling strength, which may lead to an undesirable defect that the overall coupling structure is distorted or that damage is propagated from the site where the damage is originated to another site.

Thus, it is not preferable that the second outer diameter (fd3) is too large from the viewpoint of preventing the above-described defect, and the present invention provides a preferable range of the second outer diameter (fd3). In an example on the above, the second outer diameter (fd3) may be 50% to 90%, specifically 60% to 80%, of the first outer diameter (fd2).

The inner diameter (md3) of the electron focusing part (120) is closely related to the distance to the electrons emitted from the emitter (132). This can be an important factor in the focusing level of electrons and should be carefully determined.

For example, if the inner diameter of the electron focusing part (120) is too large beyond a certain level, electrons do not focus well, the spreading of electrons may excessively occur in a beam composed of the electrons that have passed through the electron focusing part (120), and the electrons reaching the anode in this state can hardly develop a desired level of an X-ray.

On the other hand, if the inner diameter of the electron focusing part (120) is too small to deviate from a certain level, the force to focus electrons in a beam adjacent to the electron focusing part (120) is too strong, whereby the beam may be overcrossed, which may result in the spreading of electrons.

Therefore, even if the size of the X-ray emitting device (100) is designed to be relatively large, it is preferable that the inner diameter (md3) of the electron focusing part (120) falls within a predetermined range.

In an example on the above, the inner diameter (md3) of the electron focusing part (120) may be 10% to 90%, specifically 50% to 90%, of the first inner diameter (md1).

The coupling between the electron transfer part (110) and the electron focusing part (120) may be achieved as the first tube groove (114) and the first tube arm (124) are complementarily engaged with each other. Here, a ceramic-based sealing material (160) may be applied between the complementarily engaged sides of the first tube groove (114) and the first tube arm (124), and the ceramic-based sealing material (160) bonds and seals the complementarily engaged sides.

As shown in FIG. 4, when the first tube groove (114) and the first tube arm (124) are complementarily engaged with each other, fine irregularities may be formed on the surfaces of the first tube groove (114) and/or the first tube arm (124) in some cases for the purpose of increasing the bonding surface area and the frictional force. The surface roughness (or average roughness) according to the fine irregularities formed on the surfaces of the first tube groove (114) and/or the first tube arm (124) may be about 6 μm or less, about 5 μm or less, or about 3 μm or less.

As described above, the electron transfer part (110) and the electron focusing part (120) may be coupled to each other to communicate the first hollow part (112) and the second hollow part (122), thereby forming an electron transfer channel (C1). The emitter (132) of the emitter part (130) is located in the second hollow part (122) so that the electrons emitted from the emitter (132) can be focused immediately upon the emission thereof.

The emitter part (130) comprises an electrically conductive emitter holder (134) to which the emitter (132) is seated and secured and a vacuum tube (136) connected to the emitter holder (134). In such event, the emitter holder (134) is located in the second hollow part (122). The emitter holder (134) may be composed of a metallic material that is electrically conductive and is not easily deformed or melted even at high temperatures. Specifically, it may comprise any one of tungsten (W), iron (Fe), nickel (Ni), titanium (Ti), silver (Ag), copper (Cu), and chromium (Cr).

The X-ray emitting part (140) comprises a metal target plate (142) and an electrically conductive top cap (144). The metal target plate (142) comprises a first side (142*a*) and a second side (142*b*) opposite to the first side (142*a*). In such event, the central portion of the first side (142*a*) is exposed to the electron transfer channel (C1), and the peripheral portion of the first side (142*a*) excluding the central portion of the first side (142*a*) may be joined to the end of the electron transfer part (110) by brazing (170), whereby one side of the electron transfer channel (C1) is sealed.

The top cap (144) comprises a circular opening to expose the central portion of the second side (142*b*) to the outside of the electron transfer channel (C1). The top cap (144) is joined to the peripheral portion of the second side (142*b*) by brazing (170) while it is in contact with the peripheral portion of the second side (142*b*), excluding the central portion of the second side (142*b*), and the lateral side of the metal target plate (142) to surround them.

For reference, the brazing (170) in the present invention refers to joining objects that are in contact with a metallic brazing material, for example, one or more alloying materials selected from the group consisting of silver, copper, and titanium, by heating the brazing material to 700 to 800 degrees Celsius.

The X-ray emitting device (100) according to the present invention further comprises an end cap (150).

The end cap (150) comprises a penetrating hole (152). While the vacuum tube (136) of the emitter part (130) passes through the penetrating hole (152), the inner peripheral side of the penetrating hole (152) is joined to the vacuum tube (136) by brazing (170). The end cap (150) in a state in which the vacuum tube (136) is joined as described above is coupled to the second base end (121*b*) of the electron focusing part (120) so as to seal the electron transfer channel (C1) on the side of the second base end (121*b*).

The end cap (150) may be composed of a ceramic-based material, for example, the same material as that of the electron transfer part (110). It is coupled to the second base end (121*b*) of the electron focusing part (120) with a ceramic-based sealing material (160) as in the coupling between the electron focusing part (120) and the electron transfer part (110). The ceramic-based sealing material (160) is applied between at least a part of the adjacent sides of the electron focusing part (120) and the end cap (150) to bond and seal the adjacent sides.

FIGS. 5 and 6 schematically show an X-ray emitting device according to another example of the present invention.

Referring to these drawings, the X-ray emitting device (200) comprises an electron transfer part (210), an electron focusing part (220), an emitter part (230) comprising an emitter (232) for emitting electrons when a voltage is applied, and an X-ray emitting part (240).

The X-ray emitting device (200) further comprises an electron transfer channel (C2) formed by the coupling of the electron transfer part (210) and the electron focusing part (220).

In addition, the X-ray emitting device (200) further comprises a ceramic-based sealing material (260), which couples the electron transfer part (210) and the electron focusing part (220) and seals the coupled part from the outside.

The ceramic-based sealing material (260) is applied between the adjacent sides of the electron transfer part (210) and the electron focusing part (220) to bond and seal the adjacent sides. In the present invention, both the electron transfer part (210) and the electron focusing part (220) may be composed of a ceramic-based material. The ceramic-based sealing material (260) has an advantage that it may not only securely couple the electron transfer part (210) and the electron focusing part (220), which are composed of the same material, but also simplify the joining process.

The ceramic-based sealing material (260) may be a material having an adhesive strength of 1 $N/mm^2$ to 50 $N/mm^2$ to a ceramic-based material. Specifically, it may comprise a ceramic-based material that comprises O (oxygen) and further comprises at least one element selected from the group consisting of Al, Si, Cr, Mg, Y, and Zr.

The electron transfer part (210) is in the form of a tube and comprises a first base end (211*b*), a first front end (211*a*), and a first hollow part (212) extending between the first base end (211*b*) and the first front end (211*a*). In addition, the electron transfer part (210) may be composed of a ceramic-based material comprising O and further comprising at least one element selected from the group consisting of Al, Si, Cr, Mg, Y, and Zr.

The electron transfer part (210) is a tube block formed from the ceramic-based material in a mold having a predetermined shape.

The outer diameter and the inner diameter for implementing the electron transfer part may be appropriately selected from the preferable ranges described with reference to FIGS. 2 to 4.

A first tube groove (214) having a structure recessed in the direction of the outer peripheral side of the electron transfer part (210) may be formed along the inner peripheral side of the electron transfer part (210) on at least a part of the inner peripheral side of the electron transfer part adjacent (210) to the first base end (211*b*). Here, the inner peripheral side may correspond to the inner side defining the first hollow part (212), and the outer peripheral side may correspond to the outermost side of the electron transfer part (210) surrounding the first hollow part (212) with respect to the first hollow part.

The first hollow part (212) has a step in the region where the first tube groove (214) exists with reference to the vertical cross-section according to FIG. 3.

The electron focusing part (220) is a focusing electrode, which focuses electrons emitted from the emitter part (230) in random directions and reaching the electron focusing part to guide the electrons in the form of an electron beam directed in one direction to the electron transfer part (210).

The electron focusing part (220) is in the form of a tube and comprises a second base end (221*b*), a second front end (221*a*), and a second hollow part (222) extending between the second base end (221*b*) and the second front end (221*a*).

The electron focusing part (220) may be composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

The electron focusing part (220) is a tube block formed from the ceramic-based material in a mold having a predetermined shape.

A first tube arm (224) having a structure recessed in the direction of the inner peripheral side of the electron focusing part (220) is formed along the outer peripheral side of the electron focusing part (220) on at least a part of the outer peripheral side of the electron focusing part (220) adjacent to the second front end (221*a*).

In addition, a first tube arm (226) having a structure recessed in the direction of the inner peripheral side of the electron focusing part (220) is formed along the outer peripheral side of the electron focusing part on at least a part of the outer peripheral side of the electron focusing part (220) adjacent to the second base end (221*b*).

Here, the inner peripheral side may correspond to the inner side defining the second hollow part (222), and the outer peripheral side may correspond to the outermost side of the electron focusing part (220) surrounding the second hollow part (222) with respect to the second hollow part.

The outer side of the electron focusing part (220) adjacent to the second front end (221*a*) has a step in the region where the first tube arm (224) exists with reference to the vertical cross-section according to FIG. 6.

The outer side of the electron focusing part (220) adjacent to the second base end (221*b*) has another step in the region where the second tube arm (226) exists with reference to the vertical cross-section according to FIG. 6.

The outer diameter and the inner diameter for implementing the electron focusing part may be appropriately selected from the preferable ranges described referring to FIGS. 2 to 4.

The coupling between the electron transfer part (210) and the electron focusing part (220) may be achieved as the first tube groove (214) and the first tube arm (224) are complementarily engaged with each other. Here, a ceramic-based sealing material (260) may be applied between the complementarily engaged sides of the first tube groove (214) and the first tube arm (224), and the ceramic-based sealing material (260) bonds and seals the complementarily engaged sides.

When the first tube groove (214) and the first tube arm (224) are complementarily engaged with each other, fine irregularities may be formed on the surfaces of the first tube groove (114) and/or the first tube arm (224) in some cases for the purpose of increasing the bonding surface area and the frictional force. The fine irregularities are as described in FIGS. 2 to 4.

As described above, the electron transfer part (210) and the electron focusing part (220) may be coupled to each other to communicate the first hollow part (212) and the second hollow part (222), thereby forming an electron transfer channel (C2). The emitter (232) of the emitter part (230) is located in the second hollow part (222) so that the electrons emitted from the emitter (232) can be focused immediately upon the emission thereof.

The emitter part (230) comprises an electrically conductive emitter holder (234) to which the emitter (232) is seated and secured and a vacuum tube (236) connected to the emitter holder (234). In such event, the emitter holder (234) is located in the second hollow part (222). The emitter holder (234) may be composed of a metallic material that is electrically conductive and is not easily deformed or melted even at high temperatures. Specifically, it may comprise any one of tungsten (W), iron (Fe), nickel (Ni), titanium (Ti), silver (Ag), copper (Cu), and chromium (Cr).

The X-ray emitting part (240) comprises a metal target plate (242) and an electrically conductive top cap (244). The metal target plate (242) comprises a first side (242*a*) and a second side (242*b*) opposite to the first side (242*a*). In such event, the central portion of the first side (242*a*) is exposed to the electron transfer channel (C2), and the peripheral portion of the first side (242*a*) excluding the central portion of the first side (242*a*) may be joined to the end of the electron transfer part (210) by brazing (270), whereby one side of the electron transfer channel (C2) is sealed.

The top cap (244) comprises a circular opening to expose the central portion of the second side (242*b*) to the outside of the electron transfer channel (C2). The top cap (244) is joined to the peripheral portion of the second side (242*b*) by brazing (270) while it is in contact with the peripheral portion of the second side (2142*b*), excluding the central portion of the second side (242*b*), and the lateral side of the metal target plate (242) to surround them.

For reference, the brazing (270) in the present invention refers to joining objects that are in contact with a metallic brazing material, for example, one or more alloying materials selected from the group consisting of silver, copper, and titanium, by heating the brazing material to 700 to 800 degrees Celsius.

The X-ray emitting device (200) according to the present invention further comprises an end cap (250).

The end cap (250) comprises a penetrating hole (252). While the vacuum tube (236) of the emitter part (230) passes through the penetrating hole (252), the inner peripheral side of the penetrating hole (252) is joined to the vacuum tube (236) by brazing (270). The end cap (250) in a state in which the vacuum tube (236) is joined as described above is coupled to the second base end (221*b*) of the electron focusing part (220) so as to seal the electron transfer channel (C2) on the side of the second base end (221*b*).

The end cap (250) may be composed of a ceramic-based material, for example, the same material as that of the electron transfer part (210). It is coupled to the second base end (221*b*) of the electron focusing part (220) with a ceramic-based sealing material (260) as in the coupling between the electron focusing part (220) and the electron transfer part (210). The ceramic-based sealing material (260) is applied between at least a part of the adjacent sides of the electron focusing part (220) and the end cap (250) to bond and seal the adjacent sides.

A groove (254) having a complementary shape to the second tube arm (226) is formed at the central portion of the end cap (250).

Thus, the groove (254) of the end cap (250) may be complementarily engaged with the second tube arm (226).

The ceramic-based sealing material (260) is applied between the complementarily engaged sides of the groove (254) of the end cap (250) and the second tube arm (226) to bond and seal the complementarily engaged sides.

FIGS. 7 and 8 schematically show an X-ray emitting device according to still another example of the present invention.

The X-ray emitting device shown in FIGS. 7 and 8 is similar to that described above referring to FIGS. 2 to 6, except that it does not comprise an end cap and instead it has a unique structure in which the electron focusing part can function as an end cap.

This will be explained in detail.

The X-ray emitting device (300) comprises an electron transfer part (310), an electron focusing part (320), an emitter part (330) comprising an emitter (332) for emitting electrons when a voltage is applied, and an X-ray emitting part (340).

The X-ray emitting device (300) further comprises an electron transfer channel (C3) formed by the coupling of the electron transfer part (310) and the electron focusing part (320).

In addition, the X-ray emitting device (300) further comprises a ceramic-based sealing material (360), which couples the electron transfer part (310) and the electron focusing part (320) and seals the coupled part from the outside.

The ceramic-based sealing material (360) is applied between the adjacent sides of the electron transfer part (310) and the electron focusing part (320) to bond and seal the adjacent sides. In the present invention, both the electron transfer part (310) and the electron focusing part (320) may be composed of a ceramic-based material. The ceramic-based sealing material (360) has an advantage that it may not only securely couple the electron transfer part (310) and the electron focusing part (320), which are composed of the same material, but also simplify the joining process.

The ceramic-based sealing material (360) may be a material having an adhesive strength of 1 $N/mm^2$ to 50 $N/mm^2$ to a ceramic-based material. Specifically, it may comprise a ceramic-based material that comprises O (oxygen) and further comprises at least one element selected from the group consisting of Al, Si, Cr, Mg, Y, and Zr.

The electron transfer part (310) is in the form of a tube and comprises a first base end (311*b*), a first front end (311*a*), and a first hollow part (312) extending between the first base end (311*b*) and the first front end (311*a*).

In addition, the electron transfer part (310) may be composed of a ceramic-based material comprising O and further comprising at least one element selected from the group consisting of Al, Si, Cr, Mg, Y, and Zr.

The electron transfer part (310) is a tube block formed from the ceramic-based material in a mold having a predetermined shape.

The outer diameter and the inner diameter for implementing the electron transfer part may be appropriately selected from the preferable ranges described with reference to FIGS. 2 to 4.

A first tube groove (314) having a structure recessed in the direction of the outer peripheral side of the electron transfer part (310) may be formed along the inner peripheral side of the electron transfer part (310) on at least a part of the inner peripheral side of the electron transfer part adjacent (310) to the first base end (311*b*). Here, the inner peripheral side may correspond to the inner side defining the first hollow part (312), and the outer peripheral side may correspond to the outermost side of the electron transfer part (310) surrounding the first hollow part (312) with respect to the first hollow part.

The first hollow part (312) has a step in the region where the first tube groove (314) exists with reference to the vertical cross-section according to FIG. 8.

The electron focusing part (320) is a focusing electrode, which focuses electrons emitted from the emitter part (330) in random directions and reaching the electron focusing part to guide the electrons in the form of an electron beam directed in one direction to the electron transfer part (310).

The electron focusing part (320) is in the form of a tube and comprises a second base end (321*b*), a second front end (321*a*), and a second hollow part (322) extending between the second base end (321*b*) and the second front end (321*a*).

The electron focusing part (320) may be composed of an electrically conductive ceramic-based material comprising at least one metal element selected from the group consisting of Sn, Ga, In, Ti, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

The electron focusing part (320) is a tube block formed from the ceramic-based material in a mold having a predetermined shape.

A first tube arm (324) having a structure recessed in the direction of the inner peripheral side of the electron focusing part (320) is formed along the outer peripheral side of the electron focusing part (320) on at least a part of the outer peripheral side of the electron focusing part (320) adjacent to the second front end (321*a*).

Here, the inner peripheral side may correspond to the inner side defining the second hollow part (322), and the outer peripheral side may correspond to the outermost side of the electron focusing part (320) surrounding the second hollow part (322) with respect to the second hollow part.

The outer side of the electron focusing part (320) adjacent to the second front end (321*a*) has a step in the region where the first tube arm (324) exists with reference to the vertical cross-section according to FIG. 8.

The outer diameter and the inner diameter for implementing the electron focusing part may be appropriately selected from the preferable ranges described referring to FIGS. 2 to 4.

The coupling between the electron transfer part (310) and the electron focusing part (320) may be achieved as the first tube groove (314) and the first tube arm (324) are complementarily engaged with each other. Here, a ceramic-based sealing material (360) may be applied between the complementarily engaged sides of the first tube groove (314) and the first tube arm (324), and the ceramic-based sealing material (360) bonds and seals the complementarily engaged sides.

When the first tube groove (314) and the first tube arm (324) are complementarily engaged with each other, fine irregularities may be formed on the surfaces of the first tube groove (314) and/or the first tube arm (324) in some cases for the purpose of increasing the bonding surface area and the frictional force. The fine irregularities are as described in FIGS. 2 to 4.

As described above, the electron transfer part (310) and the electron focusing part (320) may be coupled to each other to communicate the first hollow part (312) and the second hollow part (322), thereby forming an electron transfer channel (C3). The emitter (332) of the emitter part (330) is located in the second hollow part (322) so that the electrons emitted from the emitter (332) can be focused immediately upon the emission thereof.

The emitter part (330) comprises an electrically conductive emitter holder (334) to which the emitter (332) is seated and secured and a vacuum tube (336) connected to the emitter holder (334). In such event, the emitter holder (334) is located in the second hollow part (322). The emitter holder (334) may be composed of a metallic material that is electrically conductive and is not easily deformed or melted even at high temperatures. Specifically, it may comprise any one of tungsten (W), iron (Fe), nickel (Ni), titanium (Ti), silver (Ag), copper (Cu), and chromium (Cr).

The X-ray emitting part (340) comprises a metal target plate (342) and an electrically conductive top cap (344). The metal target plate (342) comprises a first side (342*a*) and a second side (342*b*) opposite to the first side (342*a*). In such event, the central portion of the first side (342*a*) is exposed to the electron transfer channel (C3), and the peripheral portion of the first side (342*a*) excluding the central portion of the first side (342*a*) may be joined to the end of the electron transfer part (310) by brazing (370), whereby one side of the electron transfer channel (C3) is sealed.

The top cap (344) comprises a circular opening to expose the central portion of the second side (342*b*) to the outside of the electron transfer channel (C3). The top cap (344) is joined to the peripheral portion of the second side (342*b*) by brazing (370) while it is in contact with the peripheral portion of the second side (342*b*), excluding the central portion of the second side (342*b*), and the lateral side of the metal target plate (342) to surround them.

For reference, the brazing (370) in the present invention refers to joining objects that are in contact with a metallic brazing material, for example, one or more alloying materials selected from the group consisting of silver, copper, and titanium, by heating the brazing material to 700 to 800 degrees Celsius.

Meanwhile, a third tube arm (326) having a structure protruding inward in the radial direction of the tube may be formed along the inner peripheral side of the electron focusing part (320) on the inner peripheral side of the electron focusing part (320) adjacent to the second base end (321*b*). In other words, the third tube arm (326) may have a structure in which it extends from the inner peripheral side of the electron focusing part (320) adjacent to the second base end (321*b*) toward an imaginary central axis (A-A') that passes through the second hollow part in a direction substantially perpendicular to the axis (A-A').

The third tube arm (326) may be, for example, a substitute for the penetrating hole formed in the end cap of FIGS. 2 to 4. Specifically, while the vacuum tube (336) of the emitter part (330) passes through the space (328) defined by the inner peripheral side of the third tube arm (326), the inner peripheral side of the third tube arm (326) is joined to the vacuum tube (336) by brazing (370), thereby sealing the second base end (321*b*).

As described above, in the X-ray emitting device shown in FIGS. 7 and 8, an end cap is not required; instead, the electron focusing part, which is a focusing electrode, can function as an end cap as well. Thus, it has advantages of the manufacturing process such as the reduction of material and the processing cost due to the lack of an end cap and the simplification of the assembling process, along with an advantage that the structure can be compact and lightweight.

FIGS. 9 and 10 schematically show an X-ray emitting device according to still another example of the present invention.

The X-ray emitting device shown in FIGS. 9 and 10 is characterized in that the electron transfer part is in the form of a tube that does not comprise a first tube groove and that the electron focusing part further comprises an annular flange.

This will be explained in detail.

The X-ray emitting device (400) comprises an electron transfer part (410), an electron focusing part (420), an emitter part (430) comprising an emitter (432) for emitting electrons when a voltage is applied, and an X-ray emitting part (440).

The X-ray emitting device (400) further comprises an electron transfer channel (C4) formed by the coupling of the electron transfer part (410) and the electron focusing part (420).

In addition, the X-ray emitting device (400) further comprises a ceramic-based sealing material (460), which couples the electron transfer part (410) and the electron focusing part (420) and seals the coupled part from the outside.

The ceramic-based sealing material (460) is applied between the adjacent sides of the electron transfer part (410) and the electron focusing part (420) to bond and seal the adjacent sides. In the present invention, both the electron transfer part (410) and the electron focusing part (420) may be composed of a ceramic-based material. The ceramic-based sealing material (460) has an advantage that it may not only securely couple the electron transfer part (410) and the electron focusing part (420), which are composed of the same material, but also simplify the joining process.

The ceramic-based sealing material (460) may be a material having an adhesive strength of 1 $N/mm^2$ to 50 $N/mm^2$ to a ceramic-based material. Specifically, it may comprise a ceramic-based material that comprises O (oxygen) and further comprises at least one element selected from the group consisting of Al, Si, Cr, Mg, Y, and Zr.

The electron transfer part (410) is in the form of a tube and comprises a first base end (411*b*), a first front end (411*a*), and a first hollow part (412) extending between the first base end (411*b*) and the first front end (411*a*).

In addition, the electron transfer part (410) may be composed of a ceramic-based material comprising O and further comprising at least one element selected from the group consisting of Al, Si, Cr, Mg, Y, and Zr.

The electron transfer part (410) is a tube block formed from the ceramic-based material in a mold having a predetermined shape.

The outer diameter and the inner diameter for implementing the electron transfer part may be appropriately selected from the preferable ranges described with reference to FIGS. 2 to 4.

The electron focusing part (420) is a focusing electrode, which focuses electrons emitted from the emitter part (430) in random directions and reaching the electron focusing part to guide the electrons in the form of an electron beam directed in one direction to the electron transfer part (410).

The electron focusing part (420) is in the form of a tube and comprises a second base end (421*b*), a second front end (421*a*), and a second hollow part (422) extending between the second base end (421*b*) and the second front end (421*a*).

The electron focusing part (420) may be composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

The electron focusing part (420) is a tube block formed from the ceramic-based material in a mold having a predetermined shape.

A first tube arm (424) having a structure recessed in the direction of the inner peripheral side of the electron focusing part (420) is formed along the outer peripheral side of the electron focusing part (420) on at least a part of the outer peripheral side of the electron focusing part (420) adjacent to the second front end (421*a*).

Here, the inner peripheral side may correspond to the inner side defining the second hollow part (422), and the outer peripheral side may correspond to the outermost side of the electron focusing part (420) surrounding the second hollow part (422) with respect to the second hollow part.

The outer side of the electron focusing part (420) adjacent to the second front end (421*a*) has a step in the region where the first tube arm (424) exists with reference to the vertical cross-section according to FIG. 10.

The outer diameter and the inner diameter for implementing the electron focusing part may be appropriately selected from the preferable ranges described referring to FIGS. 2 to 4.

In addition, the electron focusing part (420) further comprises an annular flange (426) protruding outward in the radial direction of the tube from the outer peripheral side of the second base end (421*b*), that is, extending outward with respect to an imaginary central axis (A-A') parallel to the direction in which the second hollow part (422) communicates, while integrated with the first tube arm (424).

The planar shape of the annular flange (426) may correspond to the planar shape of the first base end (411*b*) of the electron transfer part (410), and the respective planar areas may be substantially the same or almost similar.

The coupling of the electron transfer part (410) and the electron focusing part (420) is in a form in which a ceramic-based sealing material (460) is applied between the adjacent sides of the annular flange (426) and the first base end (41*b*) to bond and seal the adjacent sides while at least a part of the electron focusing part (420) excluding the second base end (421*b*) and the annular flange (426), that is, the first tube arm (424), is located in the first hollow part (412).

Fine irregularities may be formed on the surfaces of the annular flange (426) and the first base end (411*b*) in some cases for the purpose of increasing the bonding surface area and the frictional force. The fine irregularities are as described in FIGS. 2 to 4.

As described above, the electron transfer part (410) and the electron focusing part (420) may be coupled to each other to communicate the first hollow part (412) and the second hollow part (422), thereby forming an electron transfer channel (C4). The emitter (432) of the emitter part (430) is located in the second hollow part (422) so that the electrons emitted from the emitter (432) can be focused immediately upon the emission thereof.

In addition, the first tube arm (424) of the electron focusing part (420) is not in contact with the inner side of the first hollow part (412), but it is spaced apart from the inner side thereof by a predetermined distance.

Meanwhile, the emitter part (430) comprises an electrically conductive emitter holder (434) to which the emitter (432) is seated and secured and a vacuum tube (436) connected to the emitter holder (434). In such event, the emitter holder (434) is located in the second hollow part (422). The emitter holder (434) may be composed of a metallic material that is electrically conductive and is not easily deformed or melted even at high temperatures. Specifically, it may comprise any one of tungsten (W), iron (Fe), nickel (Ni), titanium (Ti), silver (Ag), copper (Cu), and chromium (Cr).

The X-ray emitting part (440) comprises a metal target plate (442) and an electrically conductive top cap (444). The metal target plate (442) comprises a first side (442*a*) and a second side (442*b*) opposite to the first side (442*a*). In such event, the central portion of the first side (442*a*) is exposed to the electron transfer channel (C4), and the peripheral portion of the first side (442*a*) excluding the central portion of the first side (442*a*) may be joined to the end of the electron transfer part (410) by brazing (470), whereby one side of the electron transfer channel (C4) is sealed.

The top cap (444) comprises a circular opening to expose the central portion of the second side (442*b*) to the outside of the electron transfer channel (C4). The top cap (444) is joined to the peripheral portion of the second side (442*b*) by brazing (470) while it is in contact with the peripheral portion of the second side (442*b*), excluding the central portion of the second side (442*b*), and the lateral side of the metal target plate (442) to surround them.

For reference, the brazing (470) in the present invention refers to joining objects that are in contact with a metallic brazing material, for example, one or more alloying materials selected from the group consisting of silver, copper, and titanium, by heating the brazing material to 700 to 800 degrees Celsius.

The end cap (450) comprises a penetrating hole (452). While the vacuum tube (436) of the emitter part (430) passes through the penetrating hole (452), the inner peripheral side of the penetrating hole (452) is joined to the vacuum tube (436) by brazing (470). The end cap (450) in a state in which the vacuum tube (436) is joined as described above is coupled to the second base end (421*b*) of the electron focusing part (420) so as to seal the electron transfer channel (C4) on the side of the second base end (421*b*).

The end cap (450) may be composed of a ceramic-based material, for example, the same material as that of the electron transfer part (410). It is coupled to the second base end (421*b*) of the electron focusing part (420) with a ceramic-based sealing material (460) as in the coupling between the electron focusing part (420) and the electron transfer part (410). The ceramic-based sealing material (460) is applied between at least a part of the adjacent sides of the electron focusing part (420) and the end cap (450) to bond and seal the adjacent sides.

FIGS. 11 and 12 schematically show an X-ray emitting device according to still another example of the present invention.

Referring to these drawings, the X-ray emitting device (500) comprises an electron transfer part (510), an electron focusing part (520), an emitter part (530) comprising an emitter (532) for emitting electrons when a voltage is applied, an X-ray emitting part (540), and an end cap (550).

The X-ray emitting device (500) further comprises an electron transfer channel (C5) formed by the coupling of the electron transfer part (510) and the electron focusing part (520).

The electron transfer part (510) is in the form of a tube and comprises a first base end (511*b*), a first front end (511*a*), and a first hollow part (512) extending between the first base end (511*b*) and the first front end (511*a*).

In addition, the electron transfer part (510) may be composed of a ceramic-based material comprising O and further comprising at least one element selected from the group consisting of Al, Si, Cr, Mg, Y, and Zr.

The electron transfer part (510) is a tube block formed from the ceramic-based material in a mold having a predetermined shape.

The outer diameter and the inner diameter for implementing the electron transfer part may be appropriately selected from the preferable ranges described with reference to FIGS. 2 to 4.

The electron focusing part (520) is a focusing electrode, which focuses electrons emitted from the emitter part (530) in random directions and reaching the electron focusing part to guide the electrons in the form of an electron beam directed in one direction to the electron transfer part (510).

The electron focusing part (520) is in the form of a tube and comprises a second base end (521*b*), a second front end (521*a*), and a second hollow part (522) extending between the second base end (521*b*) and the second front end (521*a*).

The electron focusing part (520) may be composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

In addition, the electron focusing part (520) may be composed of a structure in which a ceramic paste comprising the ceramic-based material is hardened on a part of the inner peripheral side adjacent to the first base end (511*b*), that is, on the inner peripheral side of the first hollow part (512) adjacent to the first base end (511*b*), and on the first base end (51*b*).

A part of the electron focusing part (520), which is hardened on the inner peripheral side of the first hollow part (512), comprises a second front end (521*a*), wherein the other part of the electron focusing part (520), which is hardened on the first base end (511*b*), may correspond to the second base end (521*b*), and the electron focusing part (520) integrally extends from the second front end (521*a*) to the distal end of the second base end (521*b*).

The electron focusing part (520) in this example may be different from those of the above-described X-ray emitting devices in the process aspect.

Specifically, the electron focusing parts in the above examples are a preformed tube block in which a ceramic-based material is injection-molded in advance, whereas the electron focusing part (520) in this example is formed by applying a paste comprising a ceramic-based material to a specific part of the electron transfer part (510) and hardening the same.

The advantages of this example lie in that the electron focusing part (520) can be implemented by only applying and hardening a paste and that such additional materials as a ceramic-based sealing material are not required in the coupling of the electron transfer part (510) and the electron focusing part (520). As a result, it is advantages, based on the above, that the X-ray emitting device (500) can be manufactured by a simple process and is lightweight and compact in the structure once manufactured.

For reference, the outer diameter and the inner diameter of the electron focusing part (520) in the X-ray emitting device (500) having the above-described structure may be appropriately selected from the preferable ranges described with reference to FIGS. 2 to 4.

Fine irregularities may be formed on the inner peripheral side of the first hollow part (512) and on the first base end (511*b*) in some cases for the purpose of increasing the bonding surface area of the electron transfer part (510) and the electron focusing part (520) and the frictional force. The fine irregularities are substantially the same as described in FIGS. 2 to 4.

As described above, the electron transfer part (510) and the electron focusing part (520) may be coupled to each other to communicate the first hollow part (512) and the second hollow part (522), thereby forming an electron transfer channel (C5). The emitter (532) of the emitter part (530) is located in the second hollow part (522) so that the electrons emitted from the emitter (532) can be focused immediately upon the emission thereof.

The emitter part (530) comprises an electrically conductive emitter holder (534) to which the emitter (532) is seated and secured and a vacuum tube (536) connected to the emitter holder (534). In such event, the emitter holder (534) is located in the second hollow part (522). The emitter holder (534) may be composed of a metallic material that is electrically conductive and is not easily deformed or melted even at high temperatures. Specifically, it may comprise any one of tungsten (W), iron (Fe), nickel (Ni), titanium (Ti), silver (Ag), copper (Cu), and chromium (Cr).

The X-ray emitting part (540) comprises a metal target plate (542) and an electrically conductive top cap (544). The metal target plate (542) comprises a first side (542*a*) and a second side (542*b*) opposite to the first side (542*a*). In such event, the central portion of the first side (542*a*) is exposed to the electron transfer channel (C5), and the peripheral portion of the first side (542*a*) excluding the central portion of the first side (542*a*) may be joined to the end of the electron transfer part (510) by brazing (570), whereby one side of the electron transfer channel (C5) is sealed.

The top cap (544) comprises a circular opening to expose the central portion of the second side (542*b*) to the outside of the electron transfer channel (C5). The top cap (544) is joined to the peripheral portion of the second side (542*b*) by brazing (570) while it is in contact with the peripheral portion of the second side (542*b*), excluding the central portion of the second side (542*b*), and the lateral side of the metal target plate (542) to surround them.

For reference, the brazing (570) in the present invention refers to joining objects that are in contact with a metallic brazing material, for example, one or more alloying materials selected from the group consisting of silver, copper, and titanium, by heating the brazing material to 700 to 800 degrees Celsius.

The end cap (550) may be composed of a ceramic-based material or an electrically conductive metal. The ceramic-based material may be composed of, for example, the same material as that of the electron transfer part (510). The electrically conductive metal may be at least one selected from the group consisting of copper, nickel, and tin.

The coupling of the electron focusing part (520) and the end cap (550) may be achieved by bonding at least a part of the adjacent sides of the electron focusing part (520) and the end cap (550) by brazing (570).

The end cap (550) may comprise a penetrating hole (552). While the vacuum tube (536) of the emitter part (530) passes through the penetrating hole (552), the inner peripheral side of the penetrating hole (552) is joined to the vacuum tube (536) by brazing (570). The end cap (550) in a state in which the vacuum tube (536) is joined as described above is coupled to the second base end (521*b*) of the electron focusing part (520) so as to seal the electron transfer channel (C5) on the side of the second base end (521*b*).

FIG. 13 schematically shows an X-ray emitting device according to still another example of the present invention.

Referring to the drawing, the X-ray emitting device (600) comprises an electron transfer part (610), an electron focusing part (620), an emitter part (630) comprising an emitter (632) for emitting electrons when a voltage is applied, an X-ray emitting part (640), and an end cap (650).

The X-ray emitting device (600) further comprises an electron transfer channel (C6) formed by the coupling of the electron transfer part (610) and the electron focusing part (620).

The electron transfer part (610) is in the form of a tube and comprises a first base end (611*b*), a first front end (611*a*), and a first hollow part (612) extending between the first base end (611*b*) and the first front end (611*a*).

In addition, the electron transfer part (610) may be composed of a ceramic-based material comprising O and further comprising at least one element selected from the group consisting of Al, Si, Cr, Mg, Y, and Zr.

The electron transfer part (610) is a tube block formed from the ceramic-based material in a mold having a predetermined shape.

The outer diameter and the inner diameter for implementing the electron transfer part may be appropriately selected from the preferable ranges described with reference to FIGS. 2 to 4.

The electron focusing part (620) is a focusing electrode, which focuses electrons emitted from the emitter part (630) in random directions and reaching the electron focusing part to guide the electrons in the form of an electron beam directed in one direction to the electron transfer part (610).

The electron focusing part (620) is in the form of a tube and comprises a second base end (621*b*), a second front end (621*a*), and a second hollow part (622) extending between the second base end (621*b*) and the second front end (621*a*).

The electron focusing part (620) may be composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

In addition, the electron focusing part (620) may be composed of a structure in which a ceramic paste comprising the ceramic-based material is hardened on a part of the inner peripheral side adjacent to the first base end (611*b*), that is, on the inner peripheral side of the first hollow part (612) adjacent to the first base end (611*b*), and on the first base end (611*b*). Further, the electron focusing part (620) further comprises a closing part (628) formed by the hardening of a ceramic paste comprising a ceramic-based material on a part of the outer peripheral side adjacent to the first base end (611*b*).

A part of the electron focusing part (620), which is hardened on the inner peripheral side of the first hollow part (612), comprises a second front end (621*a*), wherein the other part of the electron part (620), which is hardened on the first base end (611*b*), may correspond to the second base end (621*b*), and the electron focusing part (620) integrally extends from the second front end (621*a*) to the distal end of the second base end (621*b*).

The electron focusing part (620) in this example may be different from those of the above-described X-ray emitting devices in the process aspect. Specifically, the electron focusing part in the above examples is a preformed tube block in which a ceramic-based material is injection-molded in advance, whereas the electron focusing part (620) in this example is formed by applying a paste comprising a ceramic-based material to a specific part of the electron transfer part (610) and hardening the same. The advantages of this example lie in that the electron focusing part (620) can be implemented by only applying and hardening a paste and that such additional materials as a ceramic-based sealing material are not required in the coupling of the electron transfer part (610) and the electron focusing part (620). As a result, it is advantages, based on the above, that the X-ray emitting device (600) can be manufactured by a simple process and is lightweight and compact in the structure once manufactured.

For reference, the outer diameter and the inner diameter of the electron focusing part (620) in the X-ray emitting device (600) having the above-described structure may be appropriately selected from the preferable ranges described with reference to FIGS. 2 to 4.

Fine irregularities may be formed on the inner peripheral side of the first hollow part (612), on the surfaces near the first base end (611*b*), and on the first base end (611*b*) in some cases for the purpose of increasing the bonding surface area of the electron transfer part (610) and the electron focusing part (620) and the frictional force. The fine irregularities are substantially the same as described in FIGS. 2 to 4.

As described above, the electron transfer part (610) and the electron focusing part (620) may be coupled to each other to communicate the first hollow part (612) and the second hollow part (622), thereby forming an electron transfer channel (C6). The emitter (632) of the emitter part (630) is located in the second hollow part (622) so that the electrons emitted from the emitter (632) can be focused immediately upon the emission thereof.

The emitter part (630) comprises an electrically conductive emitter holder (634) to which the emitter (632) is seated and secured and a vacuum tube (636) connected to the emitter holder (634). In such event, the emitter holder (634) is located in the second hollow part (622). The emitter holder (634) may be composed of a metallic material that is electrically conductive and is not easily deformed or melted even at high temperatures. Specifically, it may comprise any one of tungsten (W), iron (Fe), nickel (Ni), titanium (Ti), silver (Ag), copper (Cu), and chromium (Cr).

The X-ray emitting part (640) comprises a metal target plate (642) and an electrically conductive top cap (644). The metal target plate (642) comprises a first side (642*a*) and a second side (642*b*) opposite to the first side (642*a*). In such event, the central portion of the first side (642*a*) is exposed to the electron transfer channel (C6), and the peripheral portion of the first side (642*a*) excluding the central portion of the first side (642*a*) may be joined to the end of the electron transfer part (610) by brazing (670), whereby one side of the electron transfer channel (C6) is sealed.

The top cap (644) comprises a circular opening to expose the central portion of the second side (642*b*) to the outside of the electron transfer channel (C6). The top cap (644) is joined to the peripheral portion of the second side (642*b*) by brazing (670) while it is in contact with the peripheral portion of the second side (642*b*), excluding the central portion of the second side (642*b*), and the lateral side of the metal target plate (642) to surround them.

For reference, the brazing (670) in the present invention refers to joining objects that are in contact with a metallic brazing material, for example, one or more alloying materials selected from the group consisting of silver, copper, and titanium, by heating the brazing material to 700 to 800 degrees Celsius.

The end cap (650) may be composed of a ceramic-based material or an electrically conductive metal. The ceramic-based material may be composed of, for example, the same material as that of the electron transfer part (610). The electrically conductive metal may be at least one selected from the group consisting of copper, nickel, and tin.

The coupling of the electron focusing part (620) and the end cap may be achieved by bonding at least a part of the adjacent sides of the electron focusing part (620) and the end cap by brazing (670).

The end cap (650) may comprise a penetrating hole (652). While the vacuum tube (636) of the emitter part (630) passes through the penetrating hole (652), the inner peripheral side of the penetrating hole (652) is joined to the vacuum tube (636) by brazing (670). The end cap (650) in a state in which the vacuum tube (636) is joined as described above is coupled to the second base end (621*b*) of the electron focusing part (620) so as to seal the electron transfer channel (C6) on the side of the second base end (621*b*).

FIG. 14 schematically shows an X-ray emitting device according to still another example of the present invention.

The X-ray emitting device (700) according to FIG. 14 is substantially the same as that according to FIGS. 2 to 4 as described above. However, there is a difference in that the "ceramic-based sealing material for coupling of the electron transfer part and the electron focusing part" is not employed. The electron transfer part and the electron focusing part can be coupled although it is not used.

Thus, the structure and the coupling of the electron transfer part and the electron focusing part will be described in detail below, but the description of other constitutions will be omitted.

Referring to FIG. 14, the electron transfer part (710) is in the form of a tube and comprises a first base end (711*b*), a first front end (711*a*), and a first hollow part (712) extending between the first base end (711*b*) and the first front end (711*a*).

In this example, the electron transfer part (710) may be composed of a ceramic-based material comprising O and further comprising at least one element selected from the group consisting of Al, Si, Cr, Mg, Y, and Zr.

The electron transfer part (710) is a tube block formed from the ceramic-based material in a mold having a predetermined shape.

A first tube groove (714) having a structure recessed in the direction of the outer peripheral side of the electron transfer part (710) may be formed along the inner peripheral side of the electron transfer part (710) on at least a part of the inner peripheral side of the electron transfer part adjacent (710) to the first base end (711*b*). Here, the inner peripheral side may correspond to the inner side defining the first hollow part (712), and the outer peripheral side may correspond to the outermost side of the electron transfer part (710) surrounding the first hollow part (712) with respect to the first hollow part.

The electron focusing part (720) is in the form of a tube and comprises a second base end (721*b*), a second front end (721*a*), and a second hollow part (722) extending between the second base end (721*b*) and the second front end (721*a*).

The electron focusing part (720) may be composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

The electron focusing part (720) is a tube block formed from the ceramic-based material in a mold having a predetermined shape.

A first tube arm (724) having a structure recessed in the direction of the inner peripheral side of the electron focusing part (720) is formed along the outer peripheral side of the electron focusing part (720) on at least a part of the outer peripheral side of the electron focusing part (720) adjacent to the second front end (721*a*). Here, the inner peripheral side may correspond to the inner side defining the second hollow part (722), and the outer peripheral side may correspond to the outermost side of the electron focusing part (720) surrounding the second hollow part (722) with respect to the second hollow part.

The coupling between the electron transfer part (710) and the electron focusing part (720) may be achieved as the first tube groove (714) and the first tube arm (724) are complementarily engaged with each other.

More specifically, when the respective ceramic-based materials constituting the electron transfer part (710) and the electron focusing part (720) are simultaneously molded in a mold having a predetermined shape, the electron transfer part (710) and the electron focusing part (720) can be manufactured while the first tube groove (714) and the first tube arm (724) are complementarily engaged with each other.

While the electron transfer part (710) and the electron focusing part (720) thus manufactured are coupled by the complementary engagement, they are calcined at a temperature of about 700° C. or higher, specifically 700° C. to 2,000° C., so that the complementarily engaged sides of the first tube groove (714) and the first tube arm (724) are fused to be joined to each other. The respective ceramic materials constituting the electron transfer part (710) and the electron focusing part (720) are further hardened to enhance the mechanical strength.

This example has an advantage in that the manufacturing process of the X-ray emitting device can be simplified since the ceramic-based sealing material is not used, and the electron transfer part and the electron focusing part are manufactured and assembled at a time.

A schematic diagram of an X-ray emitting device according to another example having such an advantage is shown in FIGS. 15 to 17.

FIG. 15 substantially corresponds to FIGS. 5 and 6, FIG. 16 substantially corresponds to FIGS. 7 and 8, and FIG. 17 substantially corresponds to FIGS. 9 and 10, except for the "ceramic-based sealing material for coupling of the electron transfer part and the electron focusing part."

However, the X-ray emitting device shown in each of these drawings differs in that the electron transfer part and the electron focusing part are manufactured, assembled, and coupled according to substantially the same method as in FIG. 14. It has an advantage in that the manufacturing process of the X-ray emitting device can be simplified since the ceramic-based sealing material is not used, and the electron transfer part and the electron focusing part are manufactured and assembled at a time.

<Emitter>

The emitter of the present invention may comprise carbon nanotubes.

In a specific example, the emitter may be a carbon nanotube sheet that comprises carbon nanotubes.

An emitter, that is, a carbon nanotube sheet, according to an example of the present invention is shown in FIG. 18.

The carbon nanotube sheet (1100*a*) according to FIG. 18 comprises a plurality of unit yarns (1100) comprising carbon nanotubes and extending in the transverse direction and an arrangement structure in which the arrangement of the unit yarns (1110) located side by side is repeated in the longitudinal direction in a state in which the sides of one unit yarn (1110) of the plurality of unit yarns (1110) are contiguous with the sides of its neighboring unit yarns (1110).

An emitter, that is, a carbon nanotube sheet, according to another example of the present invention is shown in FIG. 19.

Referring to FIG. 19, the carbon nanotube sheet (1100*b*) comprises a plurality of unit tube (1120) that comprises unit yarns (1100) extending in the transverse direction and arranged to form a hollow.

In addition, the carbon nanotube sheet (1100*b*) comprises an arrangement structure in which the arrangement of the plurality of unit tubes (1120) located side by side is repeated in the longitudinal direction in a state in which the sides of one unit tube (1120) of the plurality of unit tubes (1120) are contiguous with the sides of its neighboring unit tubes (1120).

Each of the carbon nanotube sheets (1100*a* and 1100*b*) as described above may be processed by cutting, for example, two edges along a cutting line (H) to form a carbon nanotube sheet (1100') in a planar shape of a triangle having three internal angles as shown in FIG. 20. This is just for illustrative purposes. It may be processed to various forms such as polygons having four or more internal angles.

Noteworthy is that the cutting of the carbon nanotube sheet is performed such that any one of the ends of the unit yarns (1110) extending in the transverse direction forms at least one of the edges of the polygon or extends from the edge (1101) and that an X-ray emitting device comprising such a carbon nanotube sheet (1100') can be mounted such that the edge (1101) faces the anode of the X-ray emitting device, whereby the respective front ends of the unit yarns (1110) faces the anode.

Meanwhile, each of the carbon nanotube sheets (1100*a* and 1100*b*) shown in FIGS. 18 and 19 is rolled about an imaginary axis (B1-B1') as shown in FIG. 22 to be deformed to a sheet (1200) having a hollow (1210), which may be used as an emitter of the X-ray emitting device of the present invention. In such event, the imaginary axis (B1-B1') may be substantially parallel to the transverse direction in which the unit yarns (1110) extend.

In addition, as shown in FIG. 23, a conductive wire (1220) may be inserted into the hollow (1210) of the deformed carbon nanotube sheet (1200) shown in FIG. 22 to be deformed to another carbon nanotube sheet (1200') having a different structure, which may be used as an emitter of the X-ray emitting device of the present invention.

Although the present invention has been fully described by way of example, it is to be understood that the invention is intended to cover various modifications and equivalent arrangements included within the spirit and scope of the invention.

The invention claimed is:

1. An X-ray emitting device, which comprises an electron transfer part in the form of a tube, which comprises a first base end, a first front end, and a first hollow part extending between the first base end and the first front end;

an electron focusing part in the form of a tube, which comprises a second base end, a second front end, and a second hollow part extending between the second base end and the second front end;

an electron transfer channel formed by the coupling of the electron transfer part and the electron focusing part in which the first hollow part and the second hollow part are communicated;

an emitter part comprising an emitter that emits electrons in the electron transfer channel; and an X-ray emitting part installed at the first front end, which emits an X-ray generated by collision with an electron that passes through the electron transfer channel outside the electron transfer channel, wherein the electron focusing part is composed of an electrically conductive ceramic-based material.

2. The X-ray emitting device of claim 1, which further comprises a ceramic-based sealing material, which is applied between the adjacent sides of the electron transfer part and the electron focusing part to bond and seal the adjacent sides.

3. The X-ray emitting device of claim 1, wherein the electron transfer part is composed of a ceramic-based material comprising O and further comprising at least one element selected from the group consisting of Al, Si, Cr, Mg, Y, and Zr; and the electron focusing part is composed of an electrically conductive ceramic-based material comprising at least one metal element selected from the group consisting of Sn, Ga, In, Tl, As, Pb, Cd, Ba, Ce, Co, Fe, Gd, La, Mo, Nb, Pr, Sr, Ta, Ti, V, W, Y, Zr, Si, Sc, Ni, Al, Zn, Mg, Li, Ge, Rb, K, Hf, and Cr; and at least one element selected from the group consisting of Si, B, C, O, S, P, and N.

4. The X-ray emitting device of claim 1, wherein the electron focusing part is a focusing electrode, which focuses electrons emitted from the emitter part in random directions and reaching the electron focusing part to guide the electrons in the form of an electron beam directed in one direction to the electron transfer part, and the emitter of the emitter part is located in the second hollow part.

5. The X-ray emitting device of claim 1, wherein the emitter part comprises an electrically conductive emitter holder to which the emitter is seated and secured and a vacuum tube connected to the emitter holder, and the emitter holder is located in the second hollow part.

6. The X-ray emitting device of claim 1, wherein the X-ray emitting part comprises a metal target plate and a top cap, wherein the metal target plate comprises a first side and a second side opposite to the first side, the central portion of the first side is exposed to the electron transfer channel, and the peripheral portion of the first side excluding the central portion of the first side is joined to the end of the electron transfer part by brazing, and wherein the top cap comprises an opening to expose the central portion of the second side to the outside of the electron transfer channel and is joined to the peripheral portion of the second side by brazing while it is in contact with the peripheral portion of the second side, excluding the central portion of the second side, and the lateral side of the metal target plate to surround them.

7. The X-ray emitting device of claim 6, wherein the metal target plate of the X-ray emitting part is joined to the first front end by brazing to seal the first front end, and the second hollow part is in a sealed structure while the emitter and the emitter holder of the emitter part are located in the second hollow part.

8. The X-ray emitting device of claim 1, wherein a first tube groove having a structure recessed in the direction of the outer peripheral side of the electron transfer part is formed along the inner peripheral side of the electron transfer part on at least a part of the inner peripheral side of the electron transfer part adjacent to the first base end.

9. The X-ray emitting device of claim 8, wherein a first tube arm having a structure recessed in the direction of the inner peripheral side of the electron focusing part is formed along the outer peripheral side of the electron focusing part on at least a part of the outer peripheral side of the electron focusing part adjacent to the second front end.

10. The X-ray emitting device of claim 9, wherein the first tube groove and the first tube arm are complementarily engaged.

11. The X-ray emitting device of claim 10, wherein a ceramic-based sealing material is applied between the complementarily engaged sides of the first tube groove and the first tube arm to bond and seal the complementarily engaged sides.

12. The X-ray emitting device of claim 1, wherein the electron focusing part further comprises an annular flange protruding outward in the radial direction of the tube from the outer peripheral side of the second base end, at least a part of the electron focusing part excluding the second base end and the flange is located in the first hollow part, and a ceramic-based sealing material is applied between the adjacent sides of the flange and the first base end to bond and seal the adjacent sides.

13. The X-ray emitting device of claim 5, which further comprises an end cap, wherein the end cap comprises a penetrating hole through which the vacuum tube of the emitter part passes and the inner peripheral side of which is joined to the vacuum tube by brazing, and the end cap is coupled to the second base end to seal the second base end.

14. The X-ray emitting device of claim 13, wherein the end cap is composed of a ceramic-based material, and a ceramic-based sealing material is applied between at least a part of the adjacent sides of the electron focusing part and the end cap to bond and seal the adjacent sides.

15. The X-ray emitting device of claim 13, wherein the end cap is composed of a ceramic-based material or an electrically conductive metal, and at least a part of the adjacent sides of the electron focusing part and the end cap are joined to each other by brazing.

16. The X-ray emitting device of claim 13, wherein a second tube arm having a structure recessed in the direction of the inner peripheral side of the electron focusing part is formed along the outer peripheral side of the electron focusing part on at least a part of the outer peripheral side of the electron focusing part adjacent to the second base end, a groove having a complementary shape to the second tube arm is formed at the central portion of the end cap, and a ceramic-based sealing material is applied between the complementarily engaged sides of the groove of the end cap and the second tube arm to bond and seal the complementarily engaged sides.

17. The X-ray emitting device of claim 5, wherein a third tube arm having a structure protruding inward in the radial direction of the tube is formed along the inner peripheral side of the electron focusing part on the inner peripheral side of the electron focusing part adjacent to the second base end, and the inner peripheral side of the third tube arm and the vacuum tube are coupled by brazing to seal the second base end.

18. The X-ray emitting device of claim 1, wherein the electron focusing part is a tube block formed from the ceramic-based material in a mold having a predetermined shape.

19. The X-ray emitting device of claim 1, wherein the electron focusing part is formed by the hardening of a ceramic paste comprising a ceramic-based material on a part of the inner peripheral side adjacent to the first base end and the first base end.

20. The X-ray emitting device of claim 19, wherein the electron focusing part comprises a closing part formed by the hardening of a ceramic paste comprising a ceramic-based material on a part of the outer peripheral side adjacent to the first base end.

21. The X-ray emitting device of claim 2, wherein the ceramic-based sealing material has an adhesive strength of 1 $N/mm^2$ to 50 $N/mm^2$ to a ceramic-based material.

22. The X-ray emitting device of claim 21, wherein the electron transfer part comprises a ceramic-based material comprising O and further comprising at least one element selected from the group consisting of Al, Si, Cr, Mg, Y, and Zr.

23. The X-ray emitting device of claim 1, wherein the emitter is a carbon nanotube sheet that comprises carbon nanotubes.

* * * * *